US005819213A

United States Patent [19]

Oshikiri et al.

[11] Patent Number: 5,819,213

[45] Date of Patent: Oct. 6, 1998

[54] SPEECH ENCODING AND DECODING WITH PITCH FILTER RANGE UNRESTRICTED BY CODEBOOK RANGE AND PRESELECTING, THEN INCREASING, SEARCH CANDIDATES FROM LINEAR OVERLAP CODEBOOKS

[75] Inventors: Masahiro Oshikiri, Urayasu; Tadashi Amada, Kawasaki; Masami Akamine, Yokosuka; Kimio Miseki, Kawasaki, all of Japan

[73] Assignee: Kabushiki Kaisha Toshiba, Kawasaki, Japan

[21] Appl. No.: 791,741

[22] Filed: Jan. 30, 1997

[30] Foreign Application Priority Data

Jan. 31, 1996 [JP] Japan ..... 8-015731
Mar. 29, 1996 [JP] Japan ..... 8-076249

[51] Int. Cl.[6] ..... G10L 9/14

[52] U.S. Cl. ..... 704/222; 704/207

[58] Field of Search ..... 704/200, 201, 704/207, 219–223

[56] References Cited

U.S. PATENT DOCUMENTS

| | | | |
|---|---|---|---|
| 5,140,638 | 8/1992 | Moulsley et al. | 704/219 |
| 5,173,941 | 12/1992 | Yip et al. | 704/217 |
| 5,307,441 | 4/1994 | Tzeng | 704/222 |
| 5,664,055 | 9/1997 | Kroon | 704/223 |
| 5,677,986 | 10/1997 | Amada et al. | 704/222 |
| 5,687,284 | 11/1997 | Serizawa et al. | 704/222 |
| 5,704,002 | 12/1997 | Massaloux | 704/222 |

FOREIGN PATENT DOCUMENTS 1-261930 10/1989 Japan .

OTHER PUBLICATIONS

Masami Akamine, Kimio Miseki, and Masahiro Oshikiri, "Improvement of ADP–CELP Speech Coding at 4 kbits/s," GLobal Telecommunications Conference, GLOBECOM '91, Phoenix, AZ, pp. 1869–1873, 1991.

Juin–Hwey Chen, et al. "Adaptive Postfiltering for Quality Enhancement of Coded Speech", IEEE Transactions on Speech and Audio Processing, vol. 3, No. 1, Jan. 1995, pp. 59–71.

Yohtaro Yatsuzuka, et al. "A Variable Rate Coding By APC With Maximum Likelihood Quantization From 4.8 KBIT/S to 16 KBIT/S", IEEE ICASSP, Apr. 1986, pp. 3071–3074.

*Primary Examiner*—David R. Hudspeth
*Assistant Examiner*—Donald L. Storm
*Attorney, Agent, or Firm*—Oblon, Spivak, McClelland, Maier & Neustadt, P.C.

[57] ABSTRACT

A speech encoding method and apparatus including analyzing, using a codebook expressing speech parameters within a predetermined search range, an input speech signal in an audibility weighting filter corresponding to a pitch period longer than the search range of the codebook, and searching, from the codebook, on the basis of the analysis result, a combination of speech parameters by which the distortion of the input speech signal is minimized, and encoding the combination. The apparatus uses an adaptive codebook of pitch and a noise codebook. The codebooks search a group formed by extracting vectors of predetermined length from one original code vector, while sequentially shifting position so that the vectors overlap each other. The search group is further restricted and another preselection is made before the final search. Search is based on inversely convoluted, orthogonally transformed vectors.

22 Claims, 15 Drawing Sheets

SPEECH ENCODING AND DECODING WITH PITCH FILTER RANGE UNRESTRICTED BY CODEBOOK RANGE AND PRESELECTING, THEN INCREASING, SEARCH CANDIDATES FROM LINEAR OVERLAP CODEBOOKS

BACKGROUND OF THE INVENTION

The present invention relates to a speech encoding method of compression-encoding a speech signal and a speech decoding method of decoding a speech signal from encoded data.

A technique for coding efficiently a speech signal at a low bit rate is important in effectively utilizing radio waves and reducing the communication cost in mobile communication networks such as mobile telephones and in local communication networks. A CELP (Code Excited Linear Prediction) system is known as a speech encoding method capable of obtaining a high-quality synthesis speech at a bit rate of 8 kbps or less. This CELP system is described in detail in M. R. Schroeder and B. S. Atal, "Code Excited Linear Prediction (CELP): High Quality Speech at Very Low Bit Rates", Proc. ICASSP, pp. 937–940, 1985 (Reference 1) and W. S. Kleijin, D. J. Krasinski et al., "Improved Speech Quality and Efficient Vector Quantization in SELP", Proc. ICASSP, pp. 155–158, 1988 (Reference 2).

One component of a speech encoding apparatus using the CELP system is an adaptive codebook. This adaptive codebook performs pitch prediction analysis for input speech by a closed loop operation or analysis by synthesis. Generally, the pitch prediction analysis done by the adaptive codebook often searches a pitch period over a search range (128 candidates) of 20 to 147 samples, obtains a pitch period by which distortion with respect to a target signal is minimized, and transmits data of this pitch period as 7-bit encoded data.

If, however, an input speech signal contains a pitch period outside the above search range, this pitch period cannot be expressed by the adaptive codebook. Consequently, a pitch period different from the actual one is selected and this significantly degrades the quality of decoded speech. To widen the pitch period search range of the adaptive codebook in order to avoid this inconvenience, it is necessary to increase the number of bits of encoded data representing a pitch period. This results in an increased transmission rate.

As described above, the conventional speech encoding method encodes a pitch period within a predetermined search range into encoded data of a predetermined number of bits. Therefore, if speech containing a pitch period outside the search range is input, the quality degrades. Generally, the range of a pitch period to be encoded is experimentally verified and a proper one is chosen. However, there is no assurance that a pitch period always falls within this range. That is, it is always possible that a pitch period falls outside the pitch period search range due to the characteristics of speakers or variations in the pitch period of the same speaker.

Additionally, in the conventional speech encoding method described above, the calculation amount required to search a noise codebook occupies a large portion of the calculation amount required for the encoding processing, and the time required for the codebook search is prolonged accordingly. As one method of increasing the speed of the codebook search to solve this problem, a method called a two-stage search method is being developed. In this two-stage search method, the whole noise codebook is first rapidly searched by using a simple evaluating expression, thereby performing "pre-selection" in which a plurality of code vectors relatively close to a target vector are selected as pre-selecting candidates. Subsequently, "main selection" is performed in which an optimum code vector is selected by strictly performing distortion calculations by using the pre-selecting candidates. In this manner, high-speed codebook search is made possible.

In this method, however, if the number of stored code vectors is large as in the case of the noise codebook, i.e., if the size of a codebook is large, the calculation amount for the pre-selection increases although the evaluating expression used in the pre-selection may be simple. Consequently, no satisfactory effect of increasing the speed of the codebook search can be obtained.

To realize high-quality, low-bit-rate speech encoding by solving the two problems of the noise codebook, i.e., the problems that a large calculation amount is necessary for search and a large memory is necessary because the size of the codebook is large, a codebook with an ADP overlapped structure is proposed in Miseki et al., "3.75 kb/s ADP-CELP system", Shingaku Giho SP93-44, 1993 (Reference 3).

The characteristic features of a code vector of the ADP structure are that the code vector consists of pulses arranged at equal intervals and the pulse interval changes from one subframe to another. A pulse string as the basis of a code vector is cut out from the ADP overlapped structure codebook. In dense code vectors, this pulse string is directly used. In sparse code vectors, a predetermined number of zeros are inserted between pulses. In this sparse state, code vectors having different phases (0 and 1) can be formed in accordance with the insertion positions of zeros.

The two-stage search method described previously can also be used for this ADP overlapped structure codebook. However, when the conventional two-stage search method is applied to the ADP overlapped structure codebook, in the stage of pre-selection it is not possible to use the overlap characteristics of code vectors and the property of discrete vectors that the vectors can be made different only in the phase. Consequently, the effect of reducing the calculation amount cannot be well achieved.

BRIEF SUMMARY OF THE INVENTION

It is an object of the present invention to provide a speech encoding method and a speech decoding method capable of obtaining high-quality speech by correctly expressing the pitch period of a speech signal, and apparatuses for these methods.

It is another object of the present invention to provide a vector quantization method capable of greatly reducing a calculation amount necessary for codebook search and performing high-speed vector quantization, and a speech encoding method using this vector quantization method.

The present invention provides a speech encoding method using a codebook expressing speech parameters within a predetermined search range, which comprises encoding a speech signal by analyzing, an input speech signal in an audibility weighting filter corresponding to a pitch period longer than the search range of the codebook, and searching, from the codebook, on the basis of the analysis result, a combination of speech parameters by which the distortion of the input speech signal is minimized, and encoding the combination.

Also, the present invention provides a speech encoding apparatus comprising a codebook expressing speech parameters within a predetermined search range, an audibility weighting filter for analyzing an input speech signal on the basis of a pitch period longer than the search range of the codebook, and an encoder for searching, from the codebook, on the basis of the analysis result, a combination of speech parameters by which the distortion of the input speech signal is minimized, and encoding the combination.

Further, the present invention provides a speech encoding method for encoding a speech signal by analyzing a pitch period of an input speech signal and supplying the pitch period of the input speech signal to a pitch filter which suppresses the pitch period component, setting an analysis range of the pitch period to be supplied to the pitch filter so that the analysis range is wider than a range of a pitch period which can be expressed by encoded data of a pitch period stored in a codebook, and searching the pitch period of the input speech signal from the codebook on the basis of a result of analysis performed for the input signal by an audibility weighting filter including the pitch filter, and encoding the pitch period.

More specifically, the present invention provides a speech encoding method in which assuming that the range of the pitch period (TL) which can be expressed by the encoded data is $TLL \leqq TL \leqq TLH$ and the analysis range of the pitch period (TW) to be supplied to the pitch filter is $TWL \leqq TW \leqq TWH$, at least one of conditions $TLL > TWL$ and $TLH < TWH$ is met.

The above audibility weighting filter makes quantization noise difficult to hear by using a masking effect, thereby improving the subjective quality. This masking effect is a phenomenon in which the spectrum of input speech is masked and made difficult to hear, even if quantization noise is large, in a frequency domain where the power spectrum of the input speech is large. In contrast, in a frequency domain where the power spectrum of input speech is small, the masking effect does not work and quantization noise is readily heard. The audibility weighting filter has a function of shaping the spectrum of quantization noise such that the spectrum approaches the spectrum of input speech. The audibility weighting filter comprises an LPC synthesis filter corresponding to the spectrum envelope of speech and a pitch filter corresponding to the spectrum fine structure of speech and having a function of suppressing the pitch period component of an input speech signal.

Since the audibility weighting filter is used as a distortion scale for codebook search in the speech encoding apparatus, data representing the arrangement of the audibility weighting filter need not be supplied to a speech decoding apparatus. Accordingly, unlike the pitch period search range of an adaptive codebook which is restricted by the number of bits of encoded data, the analysis range of the pitch period to be supplied to the internal pitch filter of the audibility weighting filter can be originally freely set. By focusing attention on this fact, in the present invention, the analysis range of the pitch period to be supplied to the internal pitch filter of the audibility weighting filter is set to be much wider than the pitch period search range of the adaptive codebook.

With this arrangement, even if an input speech signal having a pitch period which cannot be represented by the pitch period search range of the adaptive codebook is supplied, the pitch period to be supplied to the pitch filter can be accurately calculated. Accordingly, by suppressing the pitch period component of the input speech signal on the basis of the calculated pitch period by using the pitch filter and performing spectrum shaping for quantization noise by using the audibility weighting filter including this pitch filter, the quality of the speech can be improved by the masking effect. Also, this processing does not change the connection between the speech encoding apparatus and the speech decoding apparatus. Consequently, the quality can be improved while the compatibility is held.

Furthermore, the present invention provides a speech decoding method comprising the steps of analyzing a pitch period of a decoded speech signal obtained by decoding encoded data, passing the decoded speech signal through a post filter including a pitch filter for emphasizing a pitch period component, and setting an analysis range of the pitch period to be supplied to the pitch filter so that the analysis range is wider than a range of a pitch period which can be expressed by the encoded data.

More specifically, the present invention provides a speech decoding method in which assuming that the range of the pitch period (TL) which can be expressed by the encoded data is TLL s TL s TLH and the analysis range of the pitch period (TP) to be supplied to the pitch filter is $TPL \leqq TP \leqq TPH$, at least one of conditions $TLL > TPL$ and $TLH < TPH$ is met.

The post filter improves the subjective quality by emphasizing formants and attenuating valleys of the spectrum of a decoded speech signal obtained by the speech decoding apparatus. As one constituent element of this post filter, the pitch filter which emphasizes the pitch period component of a decoded speech signal exists.

The post filter processes a decoded speech signal. Therefore, unlike the pitch period search range of an adaptive codebook which is restricted by the number of bits of encoded data, the analysis range of the pitch period to be supplied to the internal pitch filter of the post filter can be originally freely set. By focusing attention on this fact, in the present invention, the analysis range of the pitch period to be supplied to the internal pitch filter of the post filter is set to be much wider than the range of the pitch period which can be expressed by encoded data, i.e., the pitch period search range of the adaptive codebook.

With this arrangement, even if a decoded speech signal having a pitch period which cannot be represented by the pitch period search range of the adaptive codebook is supplied, the pitch period of the decoded speech signal can be obtained. On the basis of this pitch period, it is possible to emphasize and restore the pitch period component which cannot be transmitted and improve the quality of the speech.

Furthermore, the present invention provides a vector quantization method comprising the steps of selecting, as pre-selecting candidates, a plurality of code vectors relatively close to a target vector from a predetermined code vector group, restricting selection objects for the pre-selecting candidates to some code vectors of the code vector group, selecting some code vectors other than the selection objects from the code vector group on the basis of the pre-selecting candidates, and adding the selected code vectors as new pre-selecting candidates, thereby generating expanded pre-selecting candidates, and searching an optimum code vector closer to the target vector from the expanded pre-selecting code vectors.

In this vector quantization method, the calculation amount required for the pre-selection is reduced because the selection objects for the pre-selecting candidates are restricted. Additionally, the main selection, i.e., the search for the optimum code vector is performed for the pre-selecting candidates expanded by adding the new pre-selecting candidates on the basis of the restricted pre-selecting candidates. This ensures the search accuracy of the codebook search for searching the optimum code vector from the code vector group. Accordingly, even if the size of a codebook is large, the total calculation amount necessary for vector quantization is reduced and this makes high-speed vector quantization feasible.

This vector quantization method is particularly suited to a codebook having an overlap structure, i.e., a codebook so constituted as to be able to extract a code vector group formed by cutting out code vectors of a predetermined length from one original code vector stored while sequentially shifting positions of the code vectors such that adjacent code vectors overlap each other. If this is the case, selection objects for pre-selecting candidates are restricted to some code vectors positioned at predetermined intervals in the code vector group extracted from the overlapped structure codebook. From this code vector group, code vectors other than the selection objects and positioned near the pre-selecting candidates are added as new pre-selecting candidates, thereby generating expanded pre-selecting candidates. An optimum code vector is searched from these expanded pre-selecting candidates.

In the code vector group extracted from the overlapped structure codebook, neighboring code vectors have similar properties due to the overlap structure. Therefore, as described above, only code vectors present at predetermined intervals are used as selection objects for pre-selecting candidates, and code vectors close to the code vectors selected as the pre-selecting candidates are added to generate expanded pre-selecting candidates. Consequently, the calculation amount can be effectively reduced without lowering the search accuracy of the codebook search.

Furthermore, the present invention provides a speech encoding method comprising the processing steps of generating a drive signal by using an adaptive code vector and a noise code vector obtained by the above vector quantization method, supplying the drive signal to a synthesis filter whose filter coefficient is set on the basis of an analysis result of an input speech signal, thereby generating a synthesis speech vector, and searching an optimum adaptive code vector and an optimum noise code vector for generating a synthesis speech vector close to a target vector calculated from the input speech signal from a predetermined adaptive code vector group and a predetermined noise code vector group, respectively, characterized in that in outputting at least encoding parameters representing the data of the optimum adaptive code vector, the optimum noise code vector, and the filter coefficient, the target vector is first orthogonally transformed with respect to the optimum adaptive code vector convoluted by the synthesis filter, and then inversely convoluted by the synthesis filter, thereby generating an inversely convoluted, orthogonally transformed target vector.

Some noise code vectors in the noise code vector group are restricted as selection objects for pre-selecting candidates. Subsequently, evaluation values related to distortions of the noise code vectors as the selection objects for the pre-selecting candidates with respect to the inversely convoluted, orthogonally transformed target vector are calculated. On the basis of these evaluation values, pre-selecting candidates are selected from the noise code vectors as the selection objects. Subsequently, some noise code vectors other than the selection objects for the pre-selecting candidates are selected from the noise code vector group on the basis of the pre-selecting candidates and added to the pre-selecting candidates, thereby generating expanded pre-selecting candidates. An optimum noise code vector is searched from these expanded pre-selecting candidates.

In the above speech encoding method, selection objects for pre-selecting candidates are restricted as in the vector quantization method described earlier. This reduces the calculation amount necessary for the pre-selection of noise code vectors. Additionally, the search for the optimum noise code vector as the main selection is performed for the pre-selecting candidates expanded by adding the new pre-selecting candidates on the basis of the restricted pre-selecting candidates. This ensures the search accuracy of the noise codebook.

Furthermore, the present invention provides a vector quantization method which, by using a codebook having an overlap structure, i.e., a codebook so constituted as to be able to extract a code vector group formed by cutting out code vectors of a predetermined length from one original code vector while sequentially shifting positions of the code vectors such that adjacent code vectors overlap each other, weights each code vector of the code vector group, calculates evaluation values related to distortions of the weighted code vectors with respect to a target vector and, when searching code vectors relatively close to the target vector from the code vector group on the basis of these evaluation values, inversely convolutes the target vector, and inversely convolutes the original code vector by using the inversely convoluted target vector as a filter coefficient, thereby calculating the evaluation values.

In this vector quantization method, the original code vector is inversely convoluted by using the vector, which is obtained by inversely convoluting the target vector, as a filter coefficient, thereby obtaining the result of the inner product operation of the code vector and the target vector. This reduces the calculation amount for calculating the evaluation values necessary to search code vectors relatively close to the target vector from the code vector group.

This vector quantization method is also applicable to a two-stage search method in which codebook search is performed in two stages of pre-selection and main selection. If this is the case, each code vector of a code vector group is weighted, and evaluation values related to distortions of these weighted code vectors with respect to a target vector are calculated. On the basis of these evaluation values, a plurality of code vectors relatively close to the target vector are selected as pre-selecting candidates from the code vector group. In searching an optimum code vector closer to the target vector from the pre-selecting candidates, the target vector is inversely convoluted, and the original code vector is inversely convoluted by using this inversely convoluted target vector as a filter coefficient, thereby calculating the evaluation values for the pre-selection. In this manner, the calculation amount required for the pre-selection is reduced compared to the conventional two-stage search method.

Furthermore, the present invention provides a speech encoding method comprising the processing steps of generating a drive signal by using an adaptive code vector and a noise code vector obtained by using the second vector quantization method, supplying the drive signal to a synthesis filter whose filter coefficient is set on the basis of an analysis result of an input speech signal, thereby generating a synthesis speech vector, and searching an optimum adaptive code vector and an optimum noise code vector for generating a synthesis speech vector close to a target vector calculated from the input speech signal from an adaptive codebook and a noise codebook storing a noise code vector group formed by cutting out code vectors of a predetermined length from one original code vector while sequentially shifting positions of the code vectors such that adjacent noise code vectors overlap each other, respectively, characterized in that in outputting at least encoding parameters representing the data of the optimum adaptive code vector, the optimum noise code vector, and the filter coefficient, the target vector is orthogonally transformed with respect to the optimum adaptive code vector convoluted by the synthesis filter, and is inversely convoluted by the synthesis filter, thereby generating an inversely convoluted, orthogonally transformed target vector.

The original code vector of the noise codebook is inversely convoluted with the inversely convoluted, orthogonally transformed target vector. Evaluation values related to distortions of the noise code vectors with respect to the inversely convoluted, orthogonally transformed target vector are calculated from the inversely convoluted original code vector. Pre-selecting candidates are selected from the noise code vectors on the basis of these evaluation values. An optimum noise code vector is searched from these pre-selecting candidates.

In the above second speech encoding method, the calculation amount necessary for the pre-selection is reduced as in the second vector quantization method.

Additional object and advantages of the invention will be set forth in the description which follows, and in part will be obvious from the description, or may be learned by practice of the invention. The object and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

An embodiment of a speech encoding method according to the present invention will be described first.

Figure 1:
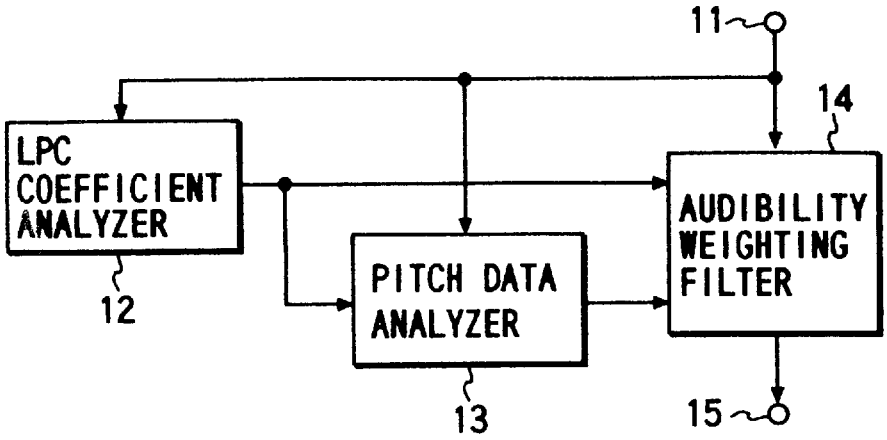
FIG. 1 is a block diagram for explaining the basic operation of an audibility weighting filter used in a speech encoding method according to one embodiment of the present invention.

With reference to FIG. 1, the basic operation of an audibility weighting filter used in a speech encoding method according to one embodiment of the present invention will be described below. In FIG. 1, a digital speech signal (input speech signal) is sequentially input from an input terminal 11 in units of frames each including a plurality samples. In this embodiment, one frame includes 80 samples. This input speech signal is supplied to an LPC coefficient analyzer 12, a pitch data analyzer 13, and an audibility weighting filter 14.

The LPC coefficient analyzer 12 analyzes the input speech signal by using any existing technique, e.g., an autocorrelation method, and obtains an LPC coefficient $\{\alpha(i);\ i=1 \text{ to } NP\}$. In this LPC analysis, it is necessary to use data having an enough length to obtain a stable analysis result centered around a frame to be analyzed of the input speech signal. NP represents the order of analysis, and NP=10 in this embodiment. The LPC coefficient $\{\alpha(i);\ i=1 \text{ to } NP\}$ thus obtained is supplied to the pitch data analyzer 13 and the audibility weighting filter 14.

The pitch data analyzer 13 analyzes the input speech signal in units of frames and obtains a pitch period TW and a pitch filter coefficient g as will be described later. Details of this pitch data analyzer 13 will be described later with reference to FIG. 2.

The audibility weighting filter 14 is a filter for shaping the spectrum of quantization noise so that the spectrum approaches the spectrum of the input speech signal. The audibility weighting filter 14 includes an LPC synthesis filter corresponding to the spectrum envelope of speech and a pitch filter which corresponds to the spectrum fine structure of speech and suppresses the pitch period component of an input speech signal. More specifically, the audibility weighting filter 14 constitutes a filter having a transfer function W(z) defined by equation (1) below on the basis of the LPC coefficient $\{\alpha(i);\ i=1 \text{ to } NP\}$ obtained from the LPC coefficient analyzer 12 and the pitch period TW and the pitch filter coefficient g obtained from the pitch data analyzer 13, thereby filtering the input speech signal which is input in units of frames, and outputting the weighted input speech signal to an output terminal 15.

$$W(z) = \frac{A(z/\beta)}{A(z/\gamma)} Q(z) \quad (1)$$

$$A(z) = 1 - \sum_{i=1}^{NP} \alpha(i) \cdot z^{-i} \quad (2)$$

$$Q(z) = 1 - g \cdot \lambda \cdot z^{-TW} \quad (3)$$

$$(0 < \gamma < \beta < 1, 0 < \lambda < 1) \quad (4)$$

$A(z/\beta)/A(z/\gamma)$ is equivalent to the audibility weighting filter corresponding to the spectrum envelope of speech, and Q(z) is equivalent to the audibility weighting filter corresponding to the spectrum fine structure of speech. As practical values of these parameters, the present inventors recommend $\beta$=0.9, $\gamma$=0.4, and $\gamma$=0.4. However, the values of these parameters depend upon the subjective taste, so these values are not necessarily optimum. The weighted input speech signal obtained by passing the input speech signal through the audibility weighting filter 14 having the transfer function W(z) defined by equation (1) is output from the output terminal 15.

Figure 2:
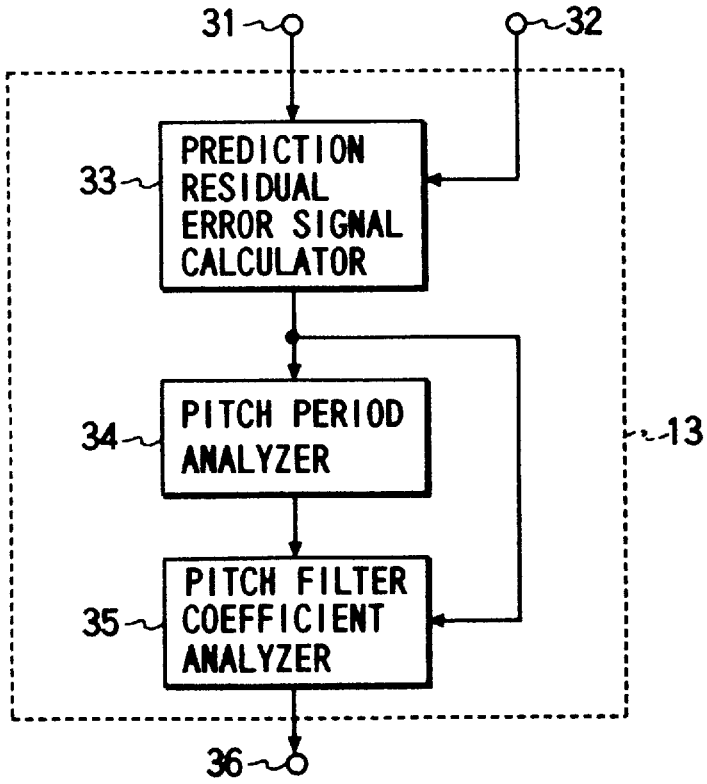
FIG. 2 is a block diagram showing the arrangement of a pitch data analyzer of the embodiment.

The pitch data analyzer 13 will be described below with reference to FIG. 2. In FIG. 2, the input speech signal and the LPC coefficient {$\alpha$(i); i=1 to NP} are input from input terminals 31 and 32, respectively, and supplied to a prediction residual error signal calculator 33. Similar to the LPC coefficient analyzer 12, the prediction residual error signal calculator 33 performs analysis by using data having an enough length to obtain a stable analysis result centered on a frame to be analyzed of the input speech signal. Assuming the data of the input speech signal to be used in the analysis is {u(n); n=0 to NU−1}, the prediction residual error signal calculator 33 calculates a prediction residual error signal {e(n); n=0 to NU−1} of the data u(n) by using the LPC coefficient {$\alpha$(i); I=1 to NP} in accordance with the following equation.

$$e(n) = u(n) - \sum_{i=1}^{NP} \alpha(i) \cdot u(u - i) \quad (5)$$

The prediction residual error signal {e(n); n=0 to N−1} thus calculated is supplied to a pitch period analyzer 34. On the basis of a signal {ew(n); n=0 to N−1} obtained by multiplying the prediction residual error signal {e(n); n=0 to N−1} by a Hamming window, the pitch period analyzer 34 calculates an autocorrelation value m(t) defined by equation (6) below within a pitch period analysis range {TWL≦t≦TWH}.

$$\phi(t) = \frac{1}{NU} \sum_{n=0}^{NU-1-t} ew(n) \cdot ew(n + t) \quad (6)$$

$$(TWL \leqq t \leqq TWH)$$

In this embodiment, a lower limit TWL and an upper limit TWH of the pitch period analysis range are set such that, for example, TWL=10 and TWH=200. On the other hand, a lower limit TLL and an upper limit TLH of a pitch period search range {TLL≦TL≦TLH} of a pitch period encoding means (e.g., an adaptive codebook to be described later) not shown in FIG. 1 are, for example, TLL=20 and TLH=147. That is, TLL>TWL and TLH<TWH; the pitch period analysis range is wider than the pitch period search range.

The value of t with which the autocorrelation value m(t) thus calculated is a maximum is supplied as the pitch period TW to a pitch filter coefficient analyzer 35. By using the prediction residual error signal {e(n); n=0 to N−1} calculated by the prediction residual error signal calculator 33 and the pitch period TW calculated by the pitch period analyzer 34, the pitch filter coefficient analyzer 35 calculates the pitch filter coefficient g in accordance with the following equation.

$$g = \frac{\sum_{n=0}^{NU-TW-1} e(n) \cdot e(n + TW)}{\sum_{n=0}^{NU-TW-1} e^2(n + TW)} \quad (7)$$

The pitch period TW and the pitch filter coefficient g thus calculated are output from an output terminal 36.

Note that the operation in which the first-order pitch filter is used has been described above, but the operation can also be realized by using a pitch filter of a higher order. If this is the case, more accurate pitch data can be obtained although the calculation amount more or less increases. Also, the methods of pitch period analysis and pitch filter coefficient analysis are not restricted to those described above, and some other techniques can also be used.

Figure 3:
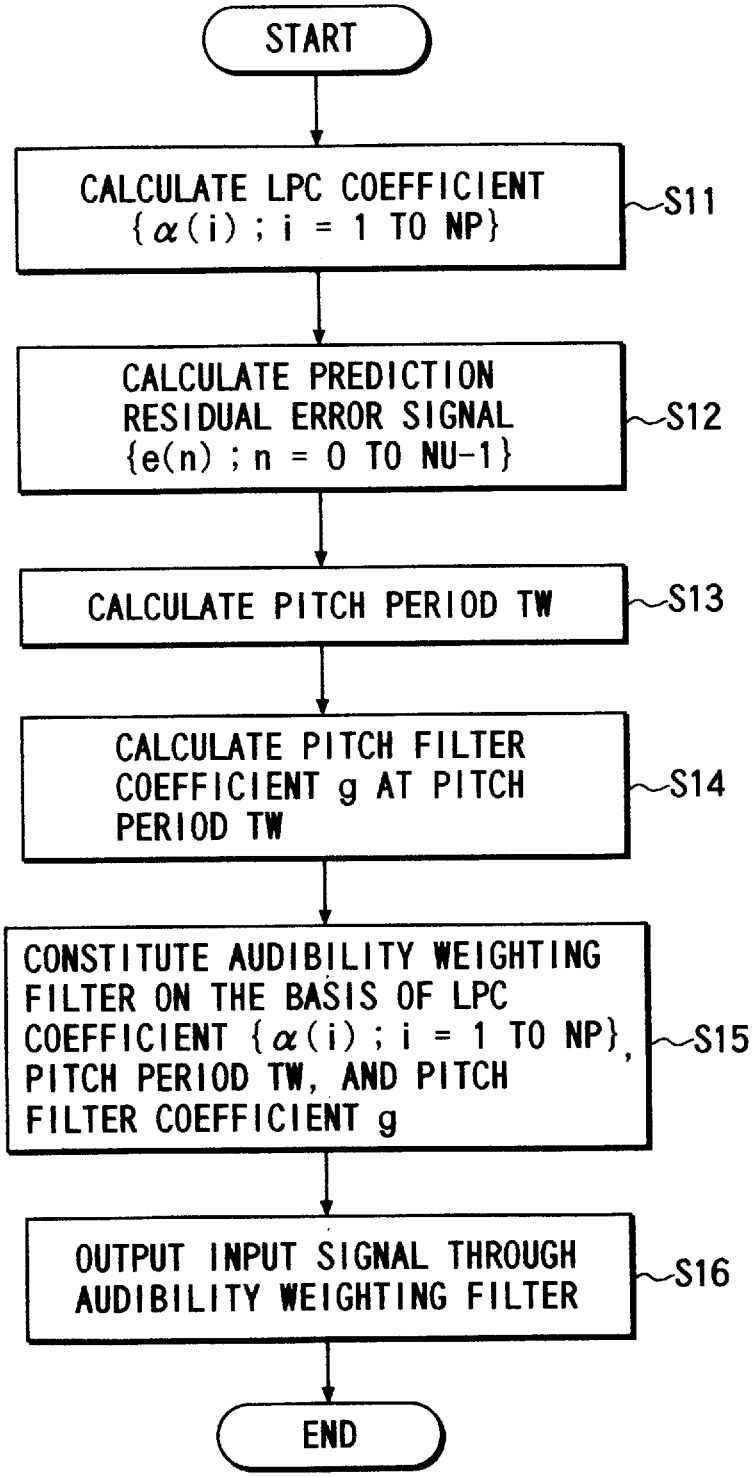
FIG. 3 is a flow chart showing a procedure of the embodiment.

A summary of the above processing is shown in the flow chart of FIG. 3. First, the LPC coefficient {$\alpha$ (i); i=1 to NP} is calculated in step S11, and the prediction residual error signal {e(n); n=0 to N−1} is calculated in step S12. The pitch period TW is analyzed in step S13, and the pitch coefficient g at the pitch period TW is calculated in step S14. In step S15, the audibility weighting filter defined by equation (1) is constituted by using the LPC coefficient {$\alpha$(i); i=1 to NP}, the pitch period TW, and the pitch filter coefficient g calculated in steps S11, S13, and S14. In step S16, the input speech signal is passed through the audibility weighting filter to generate and output the weighted input speech signal.

Figure 4:
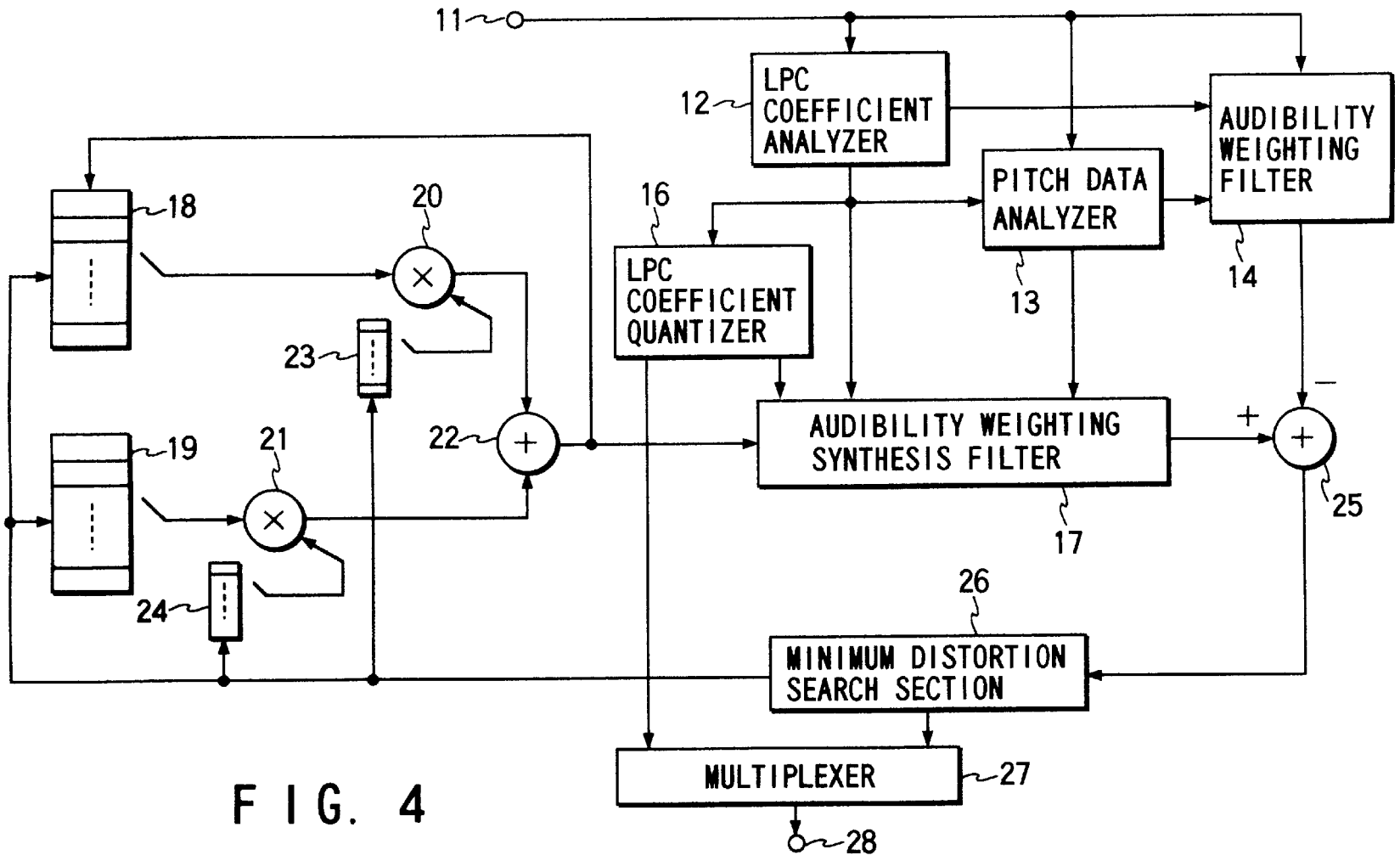
FIG. 4 is a block diagram showing the arrangement of a CELP speech synthesizer to which the speech encoding method according to the embodiment is applied.

A CELP speech encoding apparatus using the above audibility weighting filter will be described below with reference to FIG. 4. The same reference numerals as in FIG. 1 denote the same parts in FIG. 4 and a detailed description thereof will be omitted.

The output LPC coefficient {$\alpha$(i); i=1 to NP} from the LPC coefficient analyzer 12 is supplied to an LPC coefficient quantizer 16 and quantized. A weighting synthesis filter 17 receives the data of the LPC coefficient {$\alpha$(i); i=1 to NP} from the LPC coefficient analyzer 12, the data of the pitch period TW and the pitch filter coefficient g from the pitch data analyzer 13, and the data of the quantized LPC coefficient {$\alpha$(i); i=1 to NP} from the LPC coefficient quantizer 16, and constitutes a filter having a transfer function Hw(z). This transfer function Hw(z) of the weighting synthesis filter 17 is represented by the following equation.

$$Hw(z) = W(z) \cdot H(z) \quad (8)$$

In equation (8), the transfer function W(z) of the audibility weighting filter 14 is the same as defined by equation (1) presented earlier. A synthesis filter H(z) is represented by the following equation.

$$H(z) = \frac{1}{1 - \sum_{i=1}^{NP} \alpha q(i) \cdot z^{-1}} \quad (9)$$

A drive signal supplied to the weighting synthesis filter 17 is expressed by the combination of candidates of an adaptive codebook 18, an adaptive vector gain codebook 23, a noise codebook 19, and a noise vector gain codebook 24.

The adaptive codebook 18 constantly holds an immediately preceding drive signal sequence and generates adaptive vectors by repeating this drive signal sequence at a desired pitch period, thereby efficiently expressing the periodicity.

Since, however, this pitch period must be transmitted via a multiplexer, the pitch period is searched only within a range of the number of candidates which can be expressed by a predetermined number of bits. In this embodiment, a description will be made by assuming that TLL=20 and TLH=147 in a pitch period search range {TLL≦TL≦TLH} of the adaptive codebook 18.

The noise codebook 19 has a noise string as a candidate vector. Generally, the noise codebook 19 is structured to reduce the calculation amount and improve the quality.

An adaptive vector and an adaptive vector gain are selected from the adaptive codebook 18 and the adaptive vector gain codebook 23, respectively, and multiplied by a multiplier 20. Analogously, a noise vector and a noise vector gain are selected from the noise codebook 19 and the noise vector gains codebook 24, respectively, and multiplied by a multiplier 21. An adder 22 adds the output vectors from the multipliers 20 and 21 to generate a drive signal, and this drive signal is input to the weighting synthesis filter 17.

By using the output signal from the audibility weighting filter 14 as a target signal, a subtracter 25 calculates the error between the target signal and the output signal from the weighting synthesis filter 17. Also, a minimum distortion searching section 26 calculates the square distortion. The minimum distortion searching section 26 efficiently searches the combination of an adaptive vector, an adaptive vector gain, a noise vector, and a noise vector gain with which the square distortion is a minimum with respect to the adaptive codebook 18, the adaptive vector gain codebook 23, the noise codebook 19, and the noise vector gain codebook 24. The section 26 supplies the index data of candidates of an adaptive vector, an adaptive vector gain, a noise vector, and a noise vector gain, with which the square distortion is a minimum, to a multiplexer 27.

Meanwhile, index data obtained when the LPC coefficient quantizer 16 quantizes the LPC coefficient is supplied to the multiplexer 27. The multiplexer 27 converts the input index data from the LPC coefficient quantizer 16 and the minimum distortion searching section 26 into a bit stream as encoded data and outputs the bit stream to an output terminal 28. Finally, a drive signal when the square distortion calculated by the minimum distortion searching section 26 is a minimum is supplied to the adaptive codebook 18 to update its internal state, preparing for an input speech signal of the next frame.

In this embodiment as described above, the pitch period analysis range {TWL≦TW≦TWH} of the pitch data analyzer 13 used in the audibility weighting filter 14 and the weighting synthesis filter 17 and the pitch period search range {TLL≦TL≦TLH} of the adaptive codebook 18, which represents the periodicity of the drive signal to be supplied to the weighting synthesis filter 17 and is expressed by the encoded data (the encoded data of the adaptive vector index) of the pitch period encoded by the multiplexer 27 and output from the output terminal 28, meet the conditions TWL<TLL and TWH>TLH. That is, the pitch period analysis range {TWL≦TW≦TWH} is set to be wider than the pitch period search range {TLL≦TL≦TLH}.

Since these conditions are met, even if an input speech signal having a pitch period outside the pitch period search range {TLL≦TL≦TLH} of the adaptive codebook 18, which must be expressed by a predetermined number of bits, is supplied, spectrum shaping of quantization noise can be performed by the pitch period of the input speech signal and the noise can be reduced by the masking effect. This is because the analysis range {TWL≦TW≦TWH} of the internal pitch filters of the audibility weighting filter 14 and the weighting synthesis filter 17 is wider than the pitch period search range of the adaptive codebook 18. As a consequence, the subjective quality can be effectively improved.

In this embodiment, the pitch period analysis range {TWL≦TW≦TWH} and the pitch period search range {TLL≦TL≦TLH} meet both of the conditions TLL>TWL and TLH<TWH. However, it is also possible to satisfy only one of the conditions TLL>TWL and TLH<TWH.

An embodiment of a speech decoding method according to the present invention will be described next.

Figure 5:
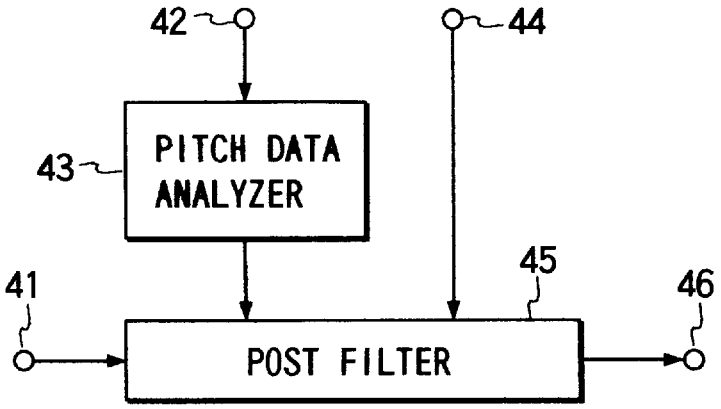
FIG. 5 is a block diagram for explaining the basic operation of a post filter used in a speech decoding method according to another embodiment of the present invention.

FIG. 5 is a block diagram for explaining the basic operation of a post filter used for a speech decoding method according to one embodiment of the present invention. In FIG. 5, a digital speech signal (e.g., a decoded speech signal) is sequentially input from an input terminal 41 in units of frames each consisting of a plurality of samples. In this embodiment, it is assumed that one frame is composed of 80 samples.

Meanwhile, an LPC prediction residual error signal, or its equivalent signal, of the speech signal from the input terminal 41, e.g., a drive signal for driving a synthesis filter of a CELP speech decoding apparatus (to be described later) is input from an input terminal 42. A pitch data analyzer 43 calculates a pitch period by using the LPC prediction residual error signal or the synthesis filter drive signal. Details of the pitch data analyzer 43 will be described later.

A post filter 45 is supplied with, e.g., the decoded speech signal from the input terminal 41, the data of a pitch period TP and a pitch filter coefficient g from the pitch data analyzer 43, and the data of an LPC coefficient {α(i); i=1 to NP} from an input terminal 44. This LPC coefficient represents the spectrum envelope of the speech signal from the input terminal 41. By using the data of the pitch period TP and the LPC coefficient {α(i); i=1 to NP}, the post filter 45 constitutes a filter represented by a transfer function R(z) defined by the following equation and filters the speech signal from the input terminal 41. The filtered output signal is output from an output terminal 46.

$$R(z)=F(z)\cdot P(z)\cdot U(z) \tag{10}$$

F(z), P(z), and B(z) are represented as follows.

$$F(z)=\frac{1-\sum_{i=1}^{NP}\alpha(i)\cdot\nu^{i}\cdot z^{-i}}{1-\sum_{i=1}^{NP}\alpha(i)\cdot\xi^{i}\cdot z^{-i}} \tag{11}$$

$$P(z)=\frac{1}{1-g\cdot\eta\cdot z^{-TP}} \tag{12}$$

$$U(z)=1-\mu\cdot z^{-1} \quad (0<\nu<\xi<1,\ 0<\eta<1,\ 0<\mu<1) \tag{13}$$

As practical values of these parameters, the present inventors recommend ν=0.5, ξ=0.8, η=0.7, μ=0.4. However, the values of these parameters depend upon the subjective taste, so these values are not necessarily optimum.

The pitch data analyzer 43 of this embodiment will be described below with reference to FIG. 6. The same reference numerals as in FIG. 2 denote the same parts in FIG. 6 and a detailed description thereof will be omitted.

Figure 6:
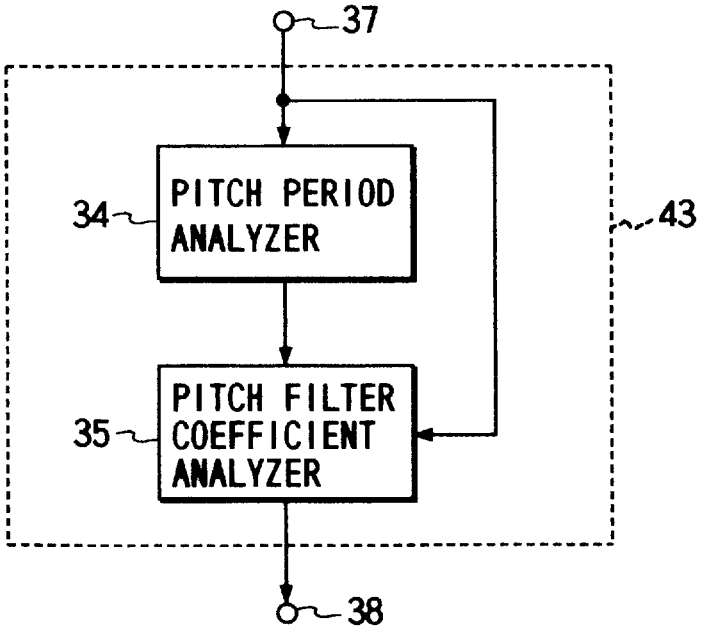
FIG. 6 is a block diagram showing the arrangement of a pitch data analyzer of the embodiment.

The difference between the pitch data analyzer 43 shown in FIG. 6 and the pitch data analyzer 13 shown in FIG. 2 of the previous embodiment is an input signal. That is, the pitch data analyzer 43 shown in FIG. 6 is supplied with a prediction residual error signal or its equivalent signal, e.g., a drive signal generated by a speech decoding apparatus (not shown). Therefore, it is not necessary to input the input speech signal and the LPC coefficient to the pitch data analyzer 43, unlike the pitch data analyzer 13 shown in FIG. 2, and so the prediction residual error signal calculator 33 is also unnecessary. The pitch data analyzer 43 shown in FIG. 6 outputs from an output terminal 38 the data of the pitch period TP calculated by a pitch period analyzer 34 and the data of the pitch filer coefficient g calculated by a pitch filter coefficient analyzer 35.

A lower limit TPL and an upper limit TPH of an analysis range {TPL≦TP≦TPH} of the pitch period TP of the pitch period analyzer 34 in the pitch data analyzer 43 are, for example, TPL=10 and TPH=200. On the other hand, a lower limit TLL and an upper limit TLH of a pitch period search range {TLL≦TL≦TLH} of a pitch period encoding means (e.g., an adaptive codebook) are TLL=20 and TLH=147. That is, TLL>TPL and TPH>TLH; the pitch period analysis range is wider than the pitch period search range.

Figure 7:
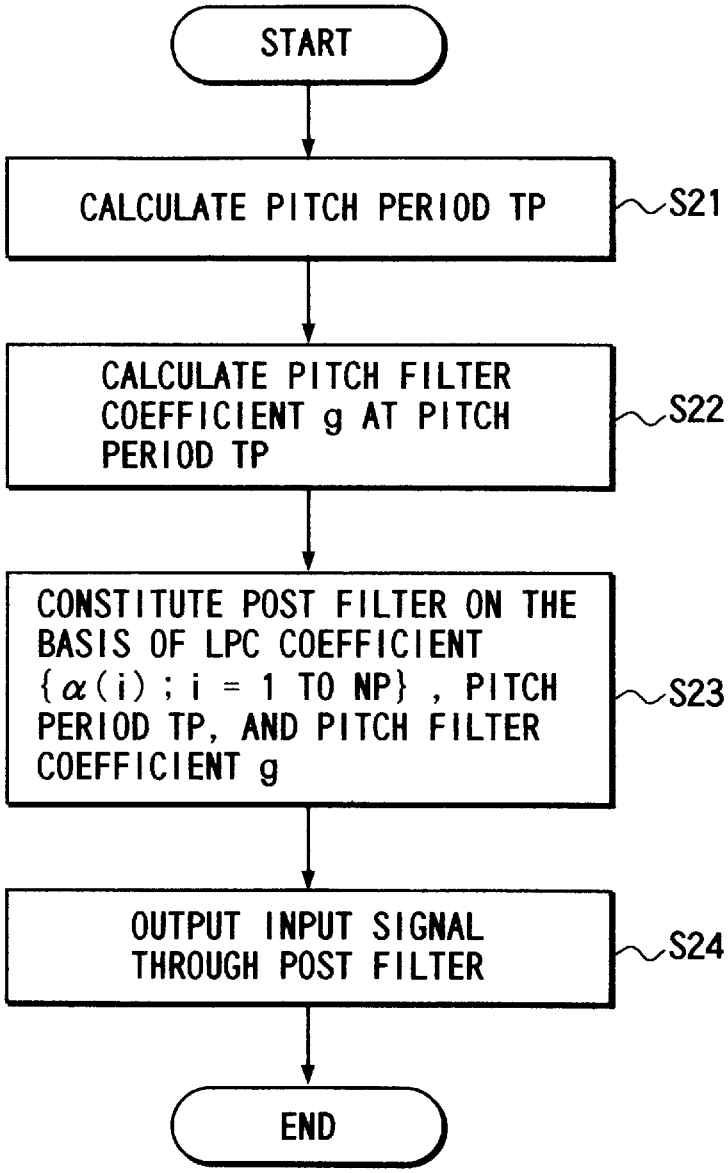
FIG. 7 is a flow chart showing a procedure of the embodiment.

A summary of the above processing is shown in the flow chart of FIG. 7. First, the pitch period TP is analyzed in step S21, and the pitch filter coefficient g at the pitch period TP is calculated in step S22. In step S23, the post filter defined by equation (10) is constituted by using the pitch period PT and the pitch filter coefficient g calculated in steps S21 and S22 and the input LPC coefficient from the input terminal 44. In step S24, the input speech signal from the input terminal 41 is output through the post filter.

A CELP speech decoding apparatus using the above post filter will be described below with reference to FIG. 8. The same reference numerals as in FIG. 5 denote the same parts in FIG. 8 and a detailed description thereof will be omitted.

Figure 8:
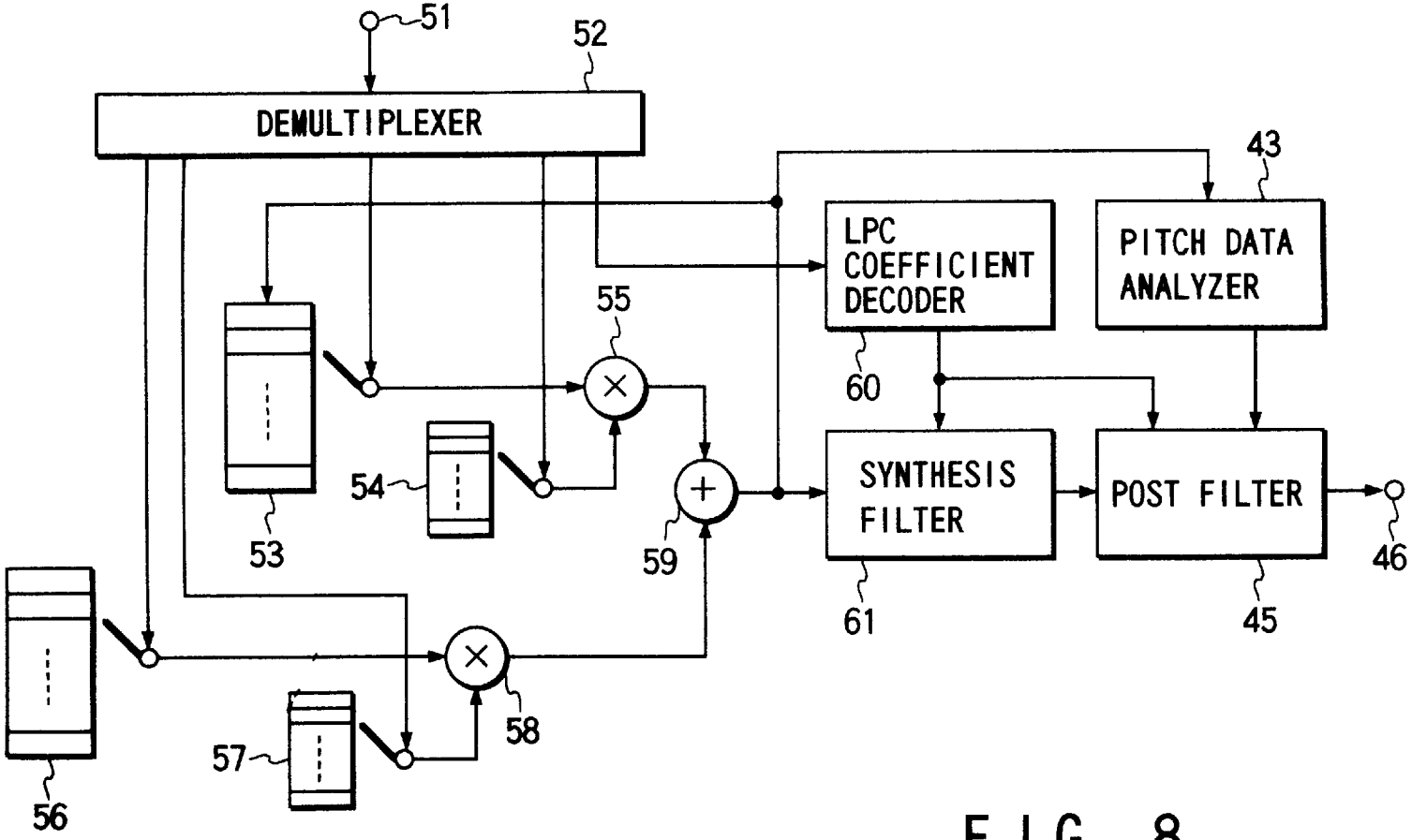
FIG. 8 is a block diagram showing the arrangement of a CELP speech decoding apparatus to which the speech decoding method according to the embodiment is applied.

In FIG. 8, a bit stream as encoded data output from a CELP speech encoding apparatus (not shown) is input to an input terminal 51 through a transmission path (not shown) or a storage medium (not shown). The speech encoding apparatus has, e.g., the arrangement as shown in FIG. 4. A demultiplexer 52 decodes parameters required to generate a speech signal from the input bit stream. The types and number of these parameters change in accordance with the arrangement of the speech encoding apparatus. In this embodiment, it is assumed that an LPC coefficient index, an adaptive vector index, an adaptive vector gain index, a noise vector index, and a noise vector gain index are decoded as the parameters.

An adaptive vector and an adaptive vector gain specified by the adaptive vector index and the adaptive vector gain index are selected from an adaptive codebook 53 and an adaptive vector gain codebook 54, respectively, and multiplied by a multiplier 55. Similarly, a noise vector and a noise vector gain specified by the noise vector index and the noise vector gain index are selected from a noise codebook 56 and a noise vector gain codebook 57, respectively, and multiplied by a multiplier 58.

An adder 59 adds the output vectors from the multipliers 55 and 58 to generate a drive signal, and this drive signal is supplied to a synthesis filter 61 and a pitch data analyzer 43. The drive signal is also supplied to the adaptive codebook 53 to update its internal state, preparing for the next input.

Meanwhile, the LPC coefficient index is supplied to an LPC coefficient decoder 60 to decode the LPC coefficient {$\alpha$(i); i=1 to NP}, and this LPC coefficient is supplied to the synthesis filter 61 and a post filter 45. A transfer function of the synthesis filter 61 is the same as defined by equation (9). Upon receiving the drive signal from the adder 59, the synthesis filter 61 performs filtering to obtain a decoded speech signal. This decoded speech signal is input to the post filter 45.

The post filter 45 and the pitch data analyzer 43 are already explained with reference to FIGS. 5 to 7 and a detailed description thereof will be omitted. In this embodiment, the decoded speech signal output from the synthesis filter 61 is input to the post filter 45, and the drive signal output from the adder 59 is input to the pitch data analyzer 43. In the speech decoding apparatus of this embodiment, the decoded speech signal passed through the post filter 45 is finally output from the output terminal 46.

In this embodiment as described above, the pitch period analysis range {TPL≦TP≦TPH} of the pitch data analyzer 43 for analyzing the pitch data in the post filter 45 and the possible range {TLL≦TL≦TLH} of the pitch period (TL) specified by the adaptive vector index, which represents the periodicity of the drive signal to be supplied to the synthesis filter 61, which is decoded by the demultiplexer 52, and which is used in the adaptive codebook 53, meet the conditions TPL<TLL and TPH>TLH. That is, the pitch period analysis range {TPL≦TP≦TPH} is set to be wider than the range {TLL≦TL≦TLH} of the pitch period which can be expressed by the encoded data (the encoded data of the adaptive vector index) of the pitch period.

Since these conditions are met, even if a decoded speech signal having a pitch period outside the pitch period search range {TLL≦TL≦TLH} of the adaptive codebook 53, which must be expressed by a predetermined number of bits, is input to the post filter 45, the pitch period which cannot be transmitted as the encoded data of the adaptive vector index can be restored. This is because the pitch analysis range {TPL≦TP≦TPH} of the pitch data analyzer 43 used in the post filter 45 is wider than the pitch period search range of the adaptive codebook 53. As a result, the subjective quality can be improved.

In this embodiment, the pitch period analysis range {TPL≦TP≦TPH} and the range {TLL≦TL≦TLH} of the pitch period capable of being expressed by the encoded data meet both the conditions TPL<TLL and TPH>TLH. However, it is also possible to satisfy only one of the conditions TPL<TLL and TPH>TLH.

Another embodiment of the present invention will be described below.

Figure 9:
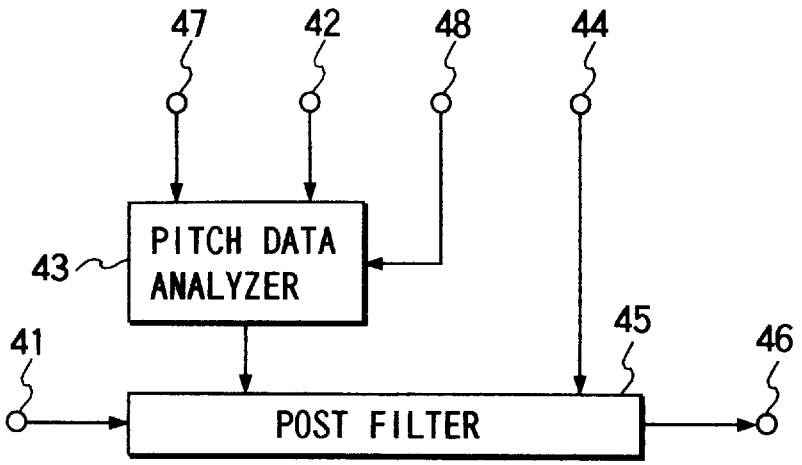
FIG. 9 is a block diagram for explaining the basic operation of a post filter using the speech decoding method according to the embodiment.

FIG. 9 is a block diagram for explaining the basic operation of a post filter used in a speech encoding method according to another embodiment of the present invention. The same reference numerals as in FIG. 5 denote the same parts in FIG. 9 and a detailed description thereof will be omitted.

This embodiment differs from the embodiment shown in FIG. 5 in that a speech decoding apparatus (not shown) has both an adaptive codebook and a fixed codebook including fixed candidate vectors prepared in advance, and that the calculation of a pitch period TP when the adaptive codebook is chosen is different from the calculation when the fixed codebook is chosen.

When the adaptive codebook is chosen, a transmitted and decoded pitch period TL of the adaptive codebook is regarded as the pitch period TP to be supplied to an internal pitch filter of the post filter. A pitch filter coefficient g is calculated by using this pitch period TP and supplied to a post filter 45. On the other hand, when the fixed codebook is chosen, a pitch data analyzer 43 newly calculates the pitch period TP, calculates the pitch filter coefficient g by using this pitch period TP, and supplies the pitch filter coefficient g to the post filter 45.

The pitch data analyzer 43 of this embodiment will be described below with reference to FIG. 10. The same reference numerals as in FIG. 6 denote the same parts in FIG. 10 and a detailed description thereof will be omitted.

Figure 10:
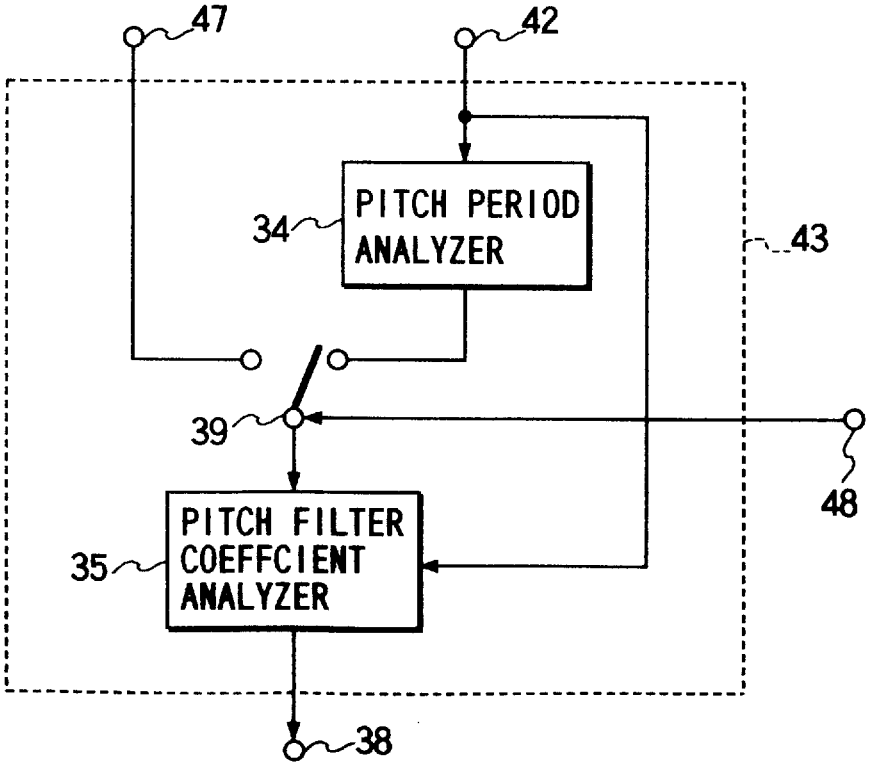
FIG. 10 is a block diagram showing the arrangement of a pitch data analyzer of the embodiment.

In FIG. 10, selection data indicating that either the adaptive codebook or the fixed codebook is used in a speech decoding apparatus (not shown) is input from an input terminal 48. If this selection data indicates the adaptive codebook, a switch 39 supplies the data of a pitch period TL of the adaptive codebook input from an input terminal 47, as the data of a pitch period TP used in the post filter, to a pitch filter coefficient analyzer 35. If the selection data from the input terminal 48 indicates the fixed codebook, the switch 39 so operates as to make an input from an input terminal 42 effective. That is, a prediction residual error signal or a drive signal sequence as an equivalent signal is input from the input terminal 42. A pitch period analyzer 34 calculates the pitch period TP on the basis of this signal and supplies the pitch period TP to the pitch filter coefficient analyzer 35. It is considered that the fixed codebook is selected because a pitch which cannot be represented by a pitch period search range {TLL≦TL23 TLH} of the adaptive codebook is generated. Accordingly, an analysis range of the pitch period analyzer 35 can be set to {TPL≦TP<TLL, TLH<TP≦TPH} excluding the pitch period search range of the adaptive codebook. Consequently, the calculation amount necessary for analysis of the pitch period can be reduced.

On the basis of the data of the pitch period TP, the pitch filter coefficient analyzer 35 calculates a pitch filter coefficient g by using the prediction residual error signal or the equivalent drive signal sequence. The analyzer 35 outputs the data of the pitch period TP and the pitch filter coefficient g from an output terminal 38.

Figure 11:
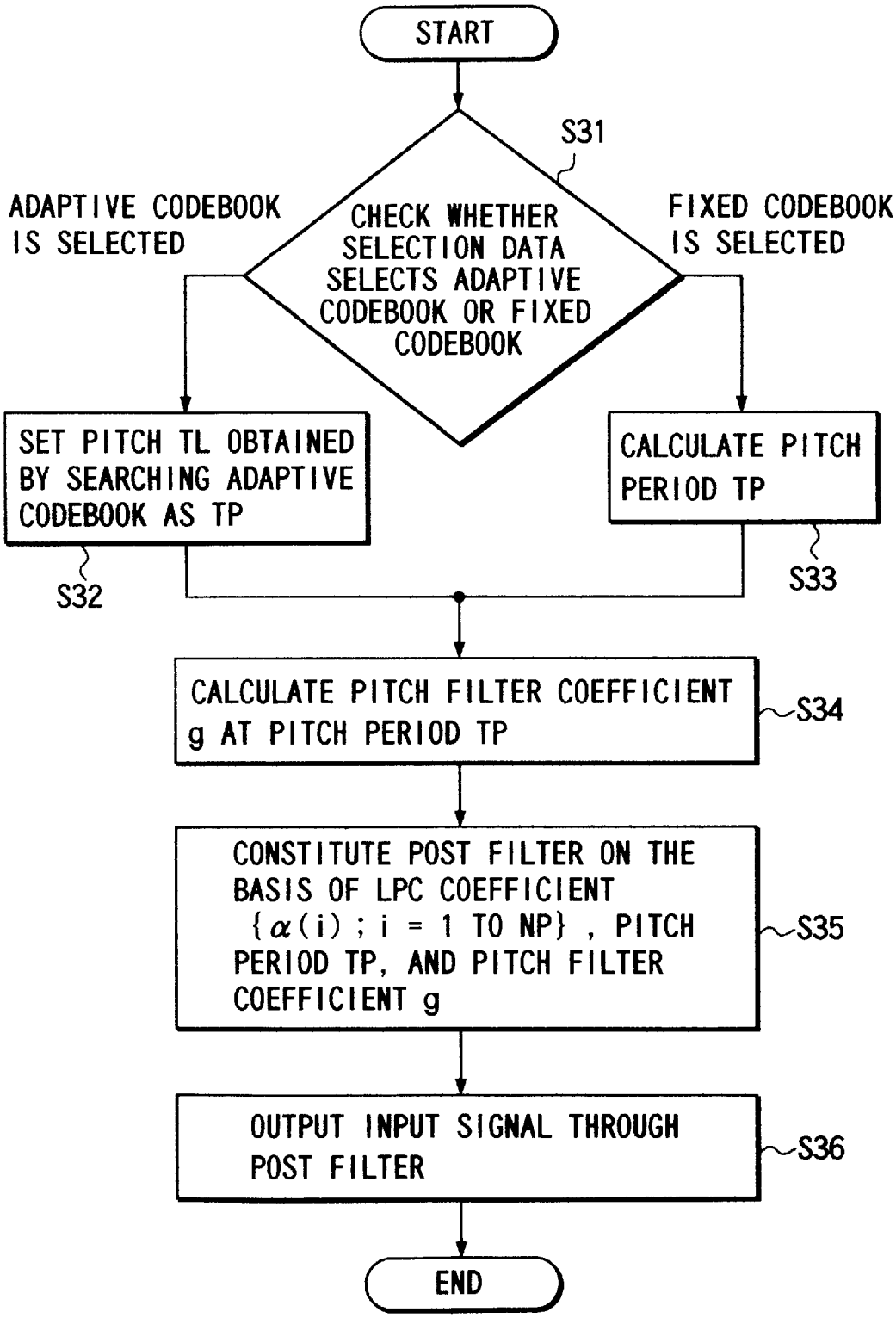
FIG. 11 is a flow chart showing a procedure of the embodiment.

A summary of the above processing is shown in the flow chart of FIG. 11. Processes in steps S33, S34, S35, and S36 of FIG. 11 are the same as in steps S21, S22, S23, and S24 of FIG. 7 and a detailed description thereof will be omitted. Note, as described previously, that the pitch period analysis range in step S33 differs from the pitch period analysis range in step S21.

First, in step S31 whether the selection data indicates the adaptive codebook or the fixed codebook is checked. If the selection data indicates the adaptive codebook, the flow advances to step S32. If the selection data indicates the fixed codebook, the flow advances to step S33. If the selection data indicates the adaptive codebook, the pitch period TL obtained by adaptive codebook search is set in step S32 as the pitch period TP used in an internal pitch filter of the post filter, and the flow advances to step S34. If the selection data indicates the fixed codebook, the pitch period TP is newly calculated in step S33, and the flow advances to step S34.

A CELP speech decoding apparatus using the above post filter will be described below with reference to FIG. 12. The same reference numerals as in FIG. 8 denote the same parts in FIG. 12 and a detailed description thereof will be omitted.

This embodiment differs from the embodiment shown in FIG. 8 in that the apparatus has both an adaptive codebook 53 and a fixed codebook 62. A description will be made mainly on the difference from the embodiment of FIG. 8.

Figure 12:
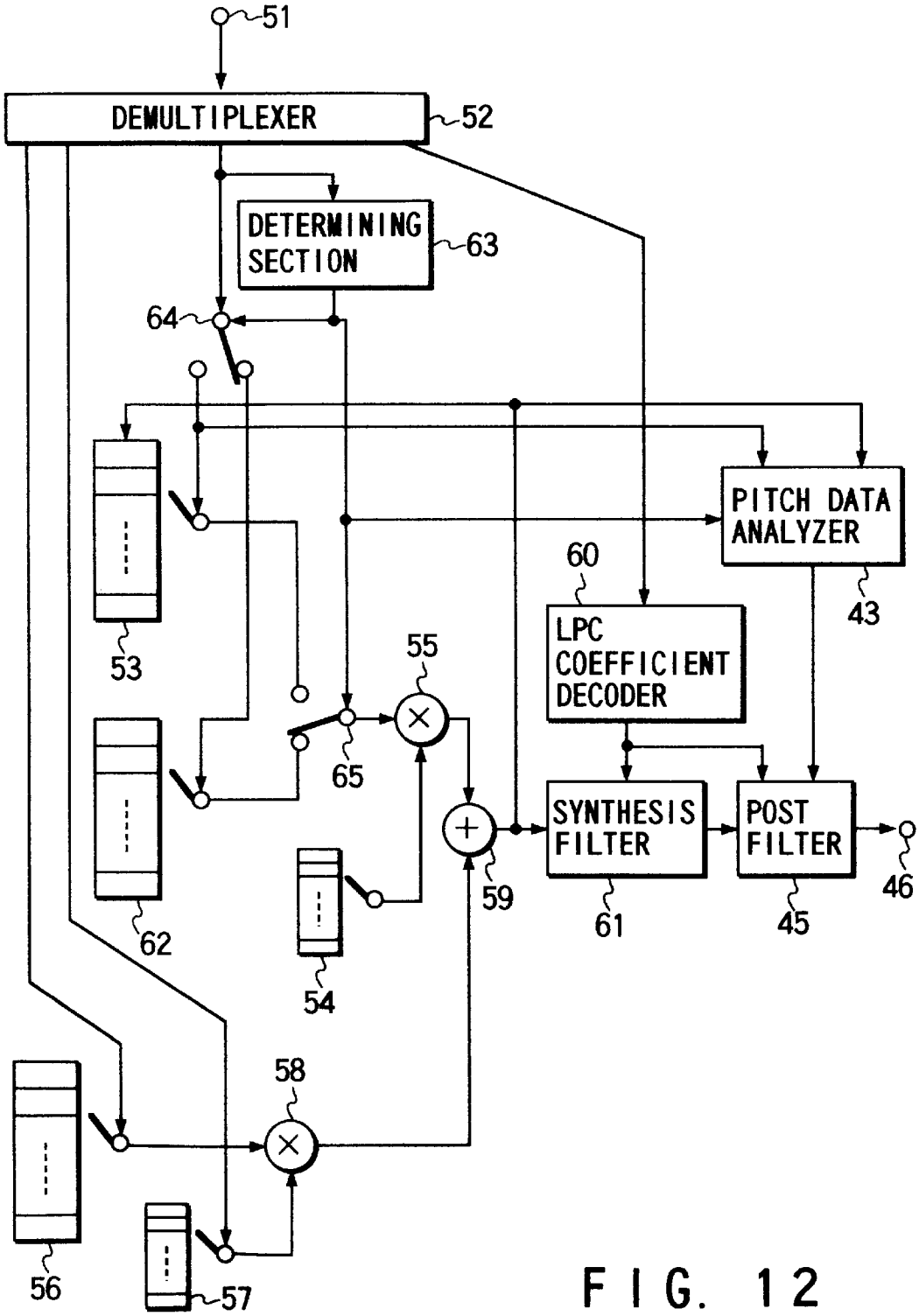
FIG. 12 is a block diagram showing the arrangement of a CELP speech decoding apparatus to which a speech decoding method according to still another embodiment of the present invention is applied.

In FIG. 12, an adaptive vector index output from a demultiplexer 52 is supplied to a determining section 63. The determining section 63 determines whether a vector to be decoded is to be generated from the adaptive codebook 53 or the fixed codebook 62. The determination result is supplied to switches 64 and 65 and a pitch data analyzer 43. In this embodiment, the adaptive vector index similarly expresses vectors generated from both the adaptive codebook 53 and the fixed codebook 62. However, the demultiplexer directly generates the determination data in some cases. In these cases, the determining section 63 is unnecessary. If this is the case, a speech encoding apparatus (not shown) has an arrangement in which determination data is given to a multiplexer as data to be transmitted. As this determination data, 1-bit additional data is necessary to distinguish between the adaptive codebook and the fixed codebook.

On the basis of the determination data from the determining section 63, the switch 64 selectively supplies the adaptive vector index to the adaptive codebook 53 or the fixed codebook 62. Similarly, on the basis of the determination data from the determining section 63, the switch 65 determines a vector to be supplied to a multiplier 55.

On the basis of the determination data from the determining section 63, the pitch data analyzer 43 switches the methods of calculating the pitch period TP of the pitch filter used in a post filter 45 as shown in FIGS. 10 and 11. The pitch period TP calculated by the pitch data analyzer 43 and the pitch filter coefficient g are supplied to the post filter 45.

The effect of the embodiment will be described below.

While the adaptive codebook 53 generates an adaptive vector capable of efficiently expressing the pitch period by using an immediately preceding drive signal sequence, a plurality of predetermined fixed vectors are prepared in the fixed codebook 62. If the pitch period of a speech signal input to the speech encoding apparatus (not shown) is included in the pitch period search range {TLL≦TL≦TLH} of the adaptive codebook 53, an adaptive vector of the adaptive codebook 53 is selected and the index of the vector is encoded.

If, however, the input speech signal has a pitch period not included in the pitch period search range of the adaptive codebook 53, the fixed codebook 62 is used instead of the adaptive codebook 53. This means that whether the pitch period of the input speech signal is included in the pitch period search range of the adaptive codebook 53 can be checked in accordance with whether the adaptive codebook 53 or the fixed codebook 62 is used.

Additionally, if the fixed codebook 62 is used, it can be determined that the pitch period analysis range of the pitch data analyzer 43 does not include the pitch period search range {TLL≦TL≦TLH} of the adaptive codebook 53. Accordingly, the pitch period analysis range can be limited to {TPL≦TP<TLL, TLH<TP≦TPH} and this reduces the calculation amount. On the other hand, if the adaptive codebook 53 is selected, it is considered that the pitch period of the input speech signal is expressed by the pitch period TL of the adaptive codebook 53. Therefore, it is only necessary to perform pitch emphasis by the internal pitch filter of the post filter 45 on the basis of the pitch period TL.

In the above embodiment, the present invention is applied to CELP speech encoding and decoding methods. However, the present invention is also applicable to speech encoding and decoding methods using another system such as an APC (Adaptive Predictive Coding) system.

As described above, the present invention can provide a speech encoding method and a speech decoding method capable of correctly expressing the pitch period of a speech signal and obtaining high-quality speech.

That is, in the speech encoding method of the present invention, the analysis range of a pitch period to be supplied to an internal pitch filter of an audibility weighting filter is set to be wider than the pitch period search range of an adaptive codebook. Accordingly, even if an input speech signal having a pitch period which cannot be represented by the pitch period search range of the adaptive codebook is supplied, the pitch period to be supplied to the pitch filter can be accurately calculated. Therefore, the pitch filter can suppress the pitch period component of the input speech signal on the basis of this pitch period, and the audibility weighting filter containing this pitch filter can perform spectrum shaping for quantization noise. As a consequence, the quality of speech can be improved by the masking effect. Also, since this processing does not change the connection between the speech encoding apparatus and the speech decoding apparatus, the quality can be improved while the compatibility is maintained.

In the speech decoding method of the present invention, the analysis range of a pitch period to be supplied to an internal pitch filter of a post filter is set to be wider than the range of a pitch period capable of being expressed by encoded data. Accordingly, even if a decoded speech signal having a pitch period which cannot be represented by encoded data is supplied, the pitch period of the decoded speech signal can be calculated. Consequently, on the basis of this calculated pitch period, it is possible to emphasize and restore the pitch period component that is not transmittable, thereby improving the quality of speech.

A vector quantizer to which a vector quantization method using a two-stage search method according to still another embodiment is applied will be described below with reference to FIG. 13.

This vector quantizer comprises an input terminal 100, a codebook 110, a restriction section 120, a pre-selector 130, a pre-selecting candidate expander 140, and a main selector 150. The input terminal 100 receives a target vector as an object of vector quantization. The codebook 110 stores code vectors. The restriction section 120 restricts some of the code vectors stored in the codebook 100 as selection objects of pre-selecting candidates for the pre-selector 130. From the code vectors restricted among the code vectors stored in the codebook 110 as the selection objects by the restriction section 120, the pre-selector 130 selects a plurality of code vectors relatively close to the input target vector to the input terminal 100 as pre-selecting candidates. On the basis of the pre-selecting candidates, the pre-selecting candidate expander 140 selects some of the code vectors stored in the codebook 110 and not restricted by the restriction section 120 and adds the selected code vectors as new pre-selecting candidates, thereby generating expanded pre-selecting candidates. The main selector 150 selects an optimum code vector closer to the target vector from the expanded pre-selecting candidates.

The pre-selector 130 comprises an evaluation value calculator 131 and an optimum value selector 132. The evaluation value calculator 131 calculates evaluation values related to distortions of the code vectors restricted as the selection objects by the restriction section 120 with respect to the target vector. On the basis of these evaluation values, the optimum value selector 132 selects a plurality of code vectors as the pre-selecting candidates from the code vectors restricted as the selection objects by the restriction section 120.

The main selector 150 comprises a distortion calculator 151 and an optimum value selector 152. The distortion calculator 151 calculates distortions of the code vectors selected as the pre-selecting candidates by the pre-selector 130 with respect to the target vector. On the basis of the distortions calculated by the distortion calculator 151, the optimum value selector 152 selects the optimum code vector from the code vectors as the pre-selecting candidates expanded by the pre-selecting candidate expander 140.

The operation of this embodiment will be described in detail below.

First, a target vector as an object of vector quantization is input to the input terminal 100. Meanwhile, of the code vectors stored in the codebook 110, some code vectors restricted by the restriction section 120 are supplied to the evaluation value calculator 131 as selection objects for pre-selecting candidates for the pre-selector 130. These code vectors are compared with the input target vector from the input terminal 100. In this comparison, the evaluation value calculator 131 calculates evaluation values on the basis of a predetermined evaluating expression. A plurality of code vectors having smaller evaluation values are selected as pre-selecting candidates by the optimum value selector 132.

The pre-selecting candidate expander 140 is supplied with the indices of the code vectors as the pre-selecting candidates from the optimum value selector 132 and the indices of the code vectors restricted as the selection objects for the pre-selecting candidates by the restriction section 120. The expander 140 adds code vectors, which are positioned around the pre-selecting candidates among the code vectors stored in the codebook 110 and are not selected as inputs to the pre-selector 130 by the restriction section 120, as new pre-selecting candidates. The original pre-selecting candidates and these new pre-selecting candidates are supplied as expanded pre-selecting candidates to the main selector 150. More specifically, the pre-selecting candidate expander 140 receives the indices of the code vectors restricted as the selection objects for the pre-selecting candidates by the restriction section 120 and the indices of the code vectors as the pre-selecting candidates from the optimum value selector 132 of the pre-selector 130, and supplies these indices as the indices of the expanded pre-selecting candidates to the main selector 150.

In the main selector 150, the distortion calculator 151 calculates distortions of the code vectors as the expanded pre-selecting candidates with respect to the target vector. The optimum value selector 152 selects a code vector (optimum code vector) having a minimum distortion. The index of this optimum code vector is output as a vector quantization result 160.

This embodiment solves the drawbacks of the conventional two-stage search method.

That is, in the conventional two-stage search method as described previously, pre-selection is performed by using all code vectors stored in a codebook as selection objects for pre-selecting candidates. Therefore, if the size of the codebook increases, the calculation amount of the pre-selection increases although the evaluating expression used in the pre-selection may be simple. The result is an unsatisfactory effect of reducing the time required for codebook search.

In this embodiment, on the other hand, the restriction section 120 first restricts selection objects for pre-selecting candidates, i.e., code vectors to be subjected to pre-selection, and the pre-selection is performed for these restricted code vectors. If search following this pre-selection is performed in the same manner as in the conventional two-stage search method, this simply means that a codebook storing a restricted small number of code vectors is searched, i.e., the size of the codebook is decreased. However, this embodiment includes the pre-selecting candidate expander 140 which, after the pre-selecting candidates are selected as above, adds some code vectors among the code vectors stored in the codebook 110, which are not input to the pre-selector 130 without being restricted by the restriction section 120 and are selected on the basis of the pre-selecting candidates, as new pre-selecting candidates, thereby expanding the pre-selecting candidates. This reduces the calculation amount of the pre-selection without decreasing the size of the codebook 110. Consequently, the calculation amount necessary for the whole vector quantization can be effectively reduced.

Assume that the number of code vectors stored in the codebook 110 is 512, the calculation amount necessary for the evaluation value calculations in the pre-selection is 10, the number of pre-selecting candidates is 4, and the calculation amount required for the main selection is 100. In the conventional two-stage search method, search is performed for all code vectors stored in the codebook in the pre-selection. Accordingly, the calculation amount required for the pre-selection is 10×512=5120. In the main selection, distortions are calculated for the four pre-selecting candidates selected in the pre-selection, so the necessary calculation amount is 4×100=400. Consequently, a total calculation amount of 5120+400=5520 is necessary in searching the optimum code vector.

In this embodiment, on the other hand, assuming that the restriction section 120 restricts code vectors as selection objects for pre-selecting candidates to 256, i.e., the half of all code vectors stored in the codebook 110, the calculation amount for the pre-selection is 256×10=2560. Assume also that four pre-selecting candidates are selected in the pre-selection, the pre-selecting candidate expander 140 adds one candidate, which is not selected by the restriction section 120, to each pre-selecting candidate, and consequently eight expanded pre-selecting candidates are output. The calculation amount required for the main selection in this case is 8×100=800. Accordingly, the total calculation amount of the pre-selection and the main selection is 2560+800=3360; that is, the optimum code vector can be searched by the calculation amount about 60% of that in the conventional method.

The vector quantization method of this embodiment is particularly effective in searching a codebook in which adjacent code vectors have similar properties, e.g., a codebook (called an overlapped codebook) having a structure in which adjacent code vectors partially overlap each other.

The procedure of vector quantization when an overlapped codebook is used as the codebook 110 in the arrangement shown in FIG. 13 will be described below with reference to the flow chart of FIG. 14. In an overlapped codebook, as shown in FIG. 15, one comparatively long original code vector is stored and code vectors of a predetermined length are sequentially cut out while being shifted from this original code vector, thereby extracting a plurality of different code vectors. For example, an ith code vector Ci is obtained by extracting N samples from the ith sample from the leading end of the original code vector. A code vector Ci+1 adjacent to this code vector Ci is shifted by one sample from Ci. This shift is not limited to one sample and can be two or more samples. In code vectors extracted from this overlapped codebook, adjacent code vectors partially overlap each other and hence have similar properties. In this embodiment, codebook search can be efficiently performed by using this property of the overlapped codebook.

Figure 14:
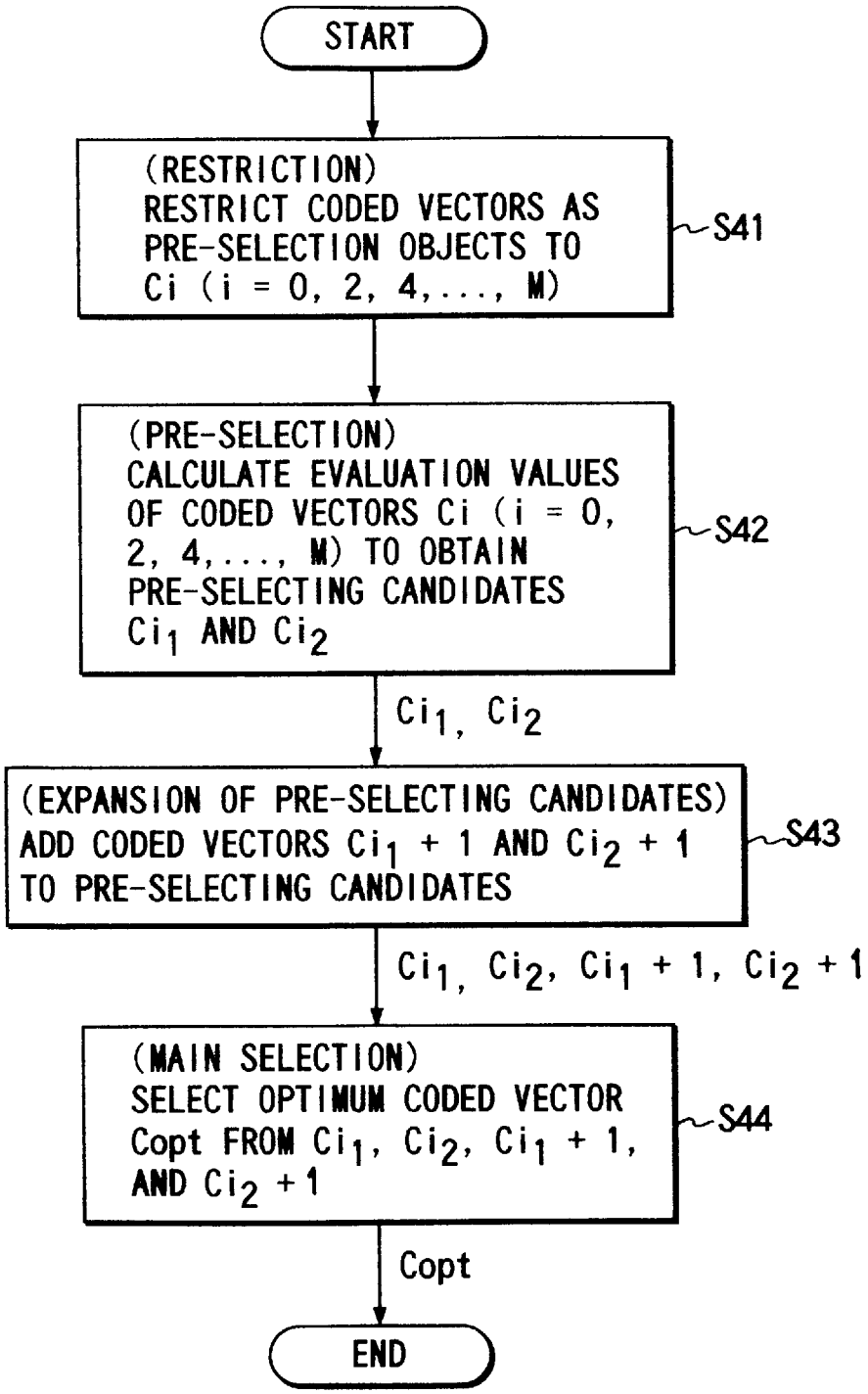
FIG. 14 is a flow chart showing the procedure of vector quantization in the vector quantizer shown in FIG. 13.
Figure 15:
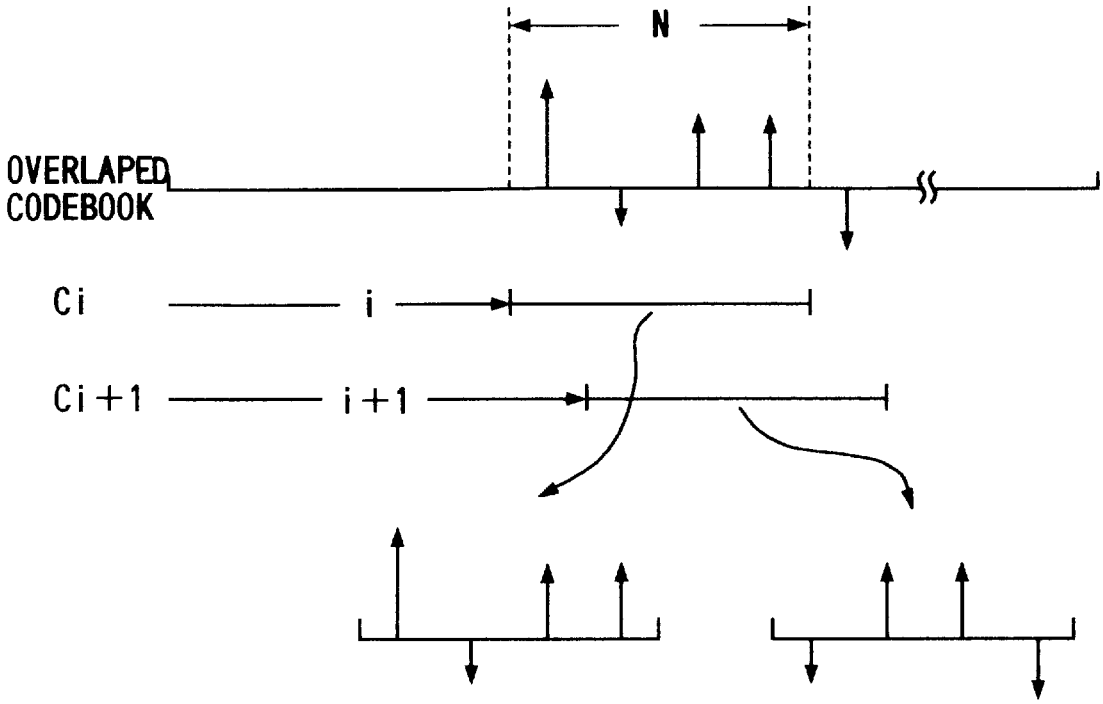
FIG. 15 is a view showing an overlapped codebook.

Referring to FIG. 14, selection objects for pre-selecting candidates are restricted to every other code vectors Ci (i=0, 2, 4, . . . , M), e.g., even-numbered samples, of code vectors extracted from the overlap coded book (step S41). Pre-selection is performed for these code vectors Ci (step S42). In this pre-selection, evaluation values for the code vectors Ci are calculated and some code vectors having smaller evaluation values are selected as pre-selecting candidates. In this embodiment, code vectors Ci1 and Ci2 are selected as the pre-selecting candidates in step S42.

Subsequently, the pre-selecting candidates are expanded to generate expanded pre-selecting candidates (step S43). That is, in step S43, code vectors $Ci_1$+1 and $Ci_2$+1 starting from odd-numbered samples adjacent to the code vectors Ci1 and Ci2 as the pre-selecting candidates are added to Ci1 and Ci2, thereby generating four code vectors Ci1, Ci2, $Ci_1$+1, and $Ci_2$+1 as the expanded pre-selecting candidates.

Main selection is then performed for these coded vectors Ci1, Ci2, $Ci_1$+1, and $Ci_2$+1 as the expanded pre-selecting candidates (step S44). That is, weighted distortions (errors with respect to the target vector), for example, of these code vectors Ci1, Ci2, $Ci_1$+1, and $Ci_2$+1 are strictly calculated. On the basis of the calculated distortions, a code vector having the smallest distortion is selected as an optimum code vector Copt. The index of this code vector is output as a final codebook search result, i.e., a vector quantization result.

When the vector quantization method of this embodiment is applied to a codebook such as an overlapped codebook in which adjacent code vectors of all code vectors have similar properties and the properties gradually change in accordance with the number of samples shifted, the calculation amount can be greatly reduced without decreasing the codebook search accuracy.

Note that in the above description, in step S41 code vectors starting from even-numbered samples are used as code vectors restricted as selection objects for pre-selecting candidates. However, code vectors starting from odd-numbered samples can also be used. It is also possible to restrict code vectors every two or more samples or at variable intervals as selection objects for pre-selecting candidates.

Figure 19:
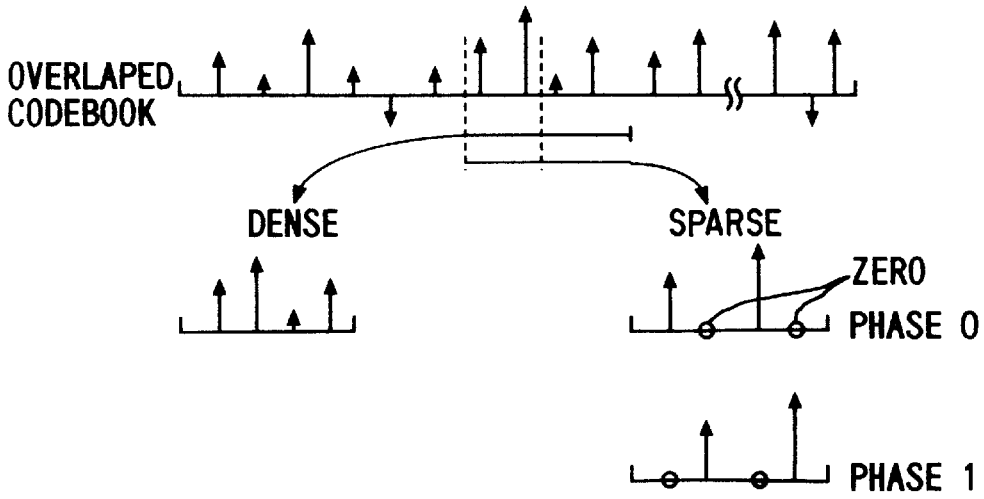
FIG. 19 is a view showing an overlapped codebook.

An example of a special form of the overlapped codebook is an overlapped codebook having an ADP structure shown in FIG. 19. From this ADP structure overlapped codebook, it is possible to extract sparse code vectors and dense code vectors as code vectors. The discrete vectors can be obtained by previously inserting 0 in code vectors of an overlapped codebook and extracting the code vectors by regarding the codebook as an ordinary overlapped codebook. In this sense, the ADP structure overlapped codebook can be considered as one form of the overlapped codebook. Therefore, assume that the overlapped codebook in the present invention includes the ADP structure overlapped codebook.

When the ADP structure overlapped codebook is used, a pair of sparse code vectors different only in the phase can be obtained. These code vectors are analogous except, as shown in FIG. 19, that the positions of 0 are different. Accordingly, only code vectors having a phase of 0 are used as selection objects for pre-selecting candidates. In expanding the pre-selecting candidates, code vectors having a phase of 1 are added to the corresponding code vectors as the pre-selecting candidates, thereby generating expanded pre-selecting candidates. These expanded pre-selecting candidates are transferred to main selection. By this method, it is possible to efficiently reduce the calculation amount without lowering the performance of vector quantization.

In the above explanation, the pre-selecting candidate expander 140 transfers the indices of the code vectors as the expanded pre-selecting candidates to the main selector 150. However, it is also possible to transfer the code vectors themselves as the expanded pre-selecting candidates. More specifically, code vectors selected as pre-selecting candidates by the pre-selector 130 and code vectors whose distances from these pre-selecting candidate code vectors are a predetermined value or less are extracted from the codebook 110 and transferred as code vectors as expanded pre-selecting candidates to the main selector 150.

Figure 13:
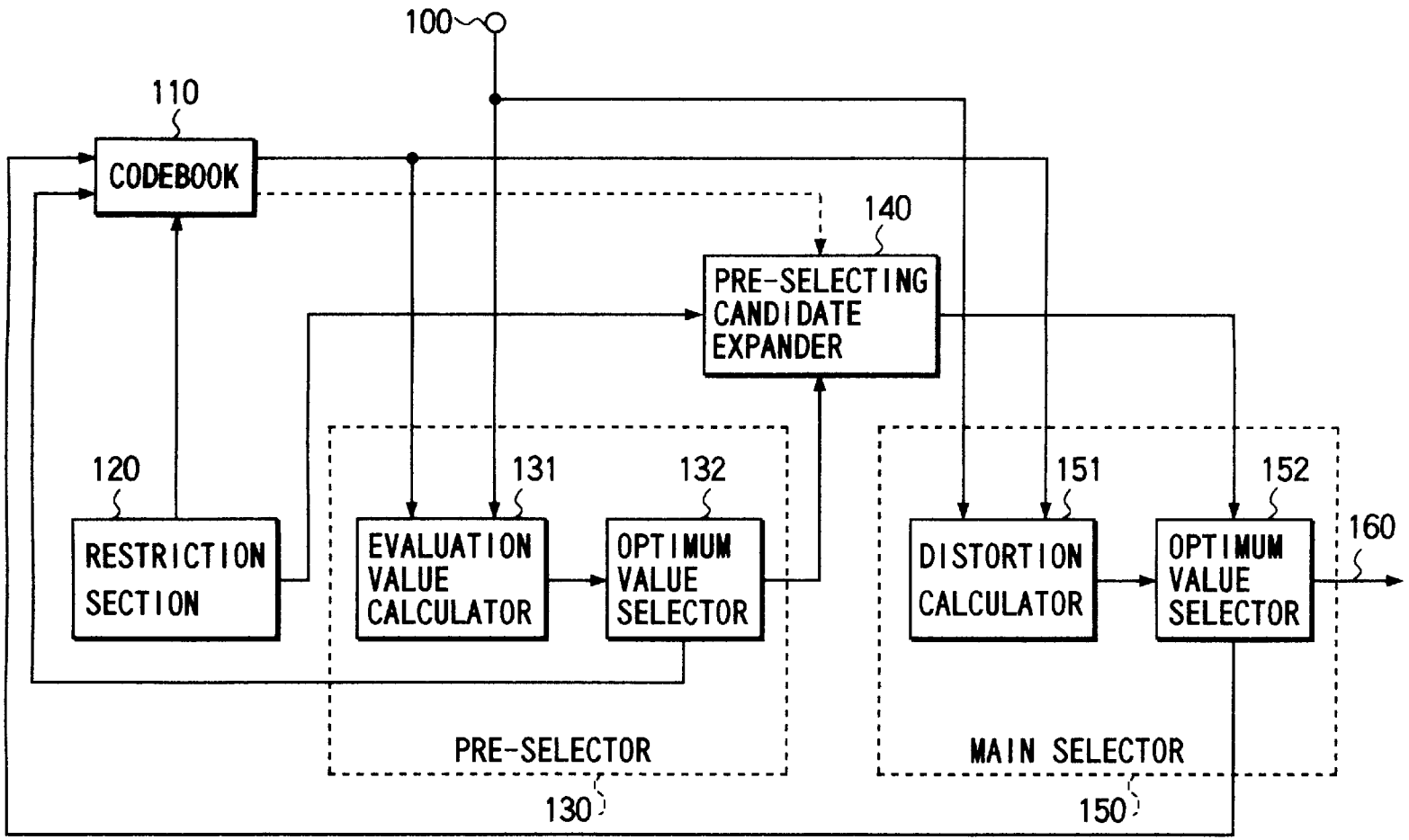
FIG. 13 is a block diagram showing the arrangement of a vector quantizer according to still another embodiment of the present invention.
Figure 16:
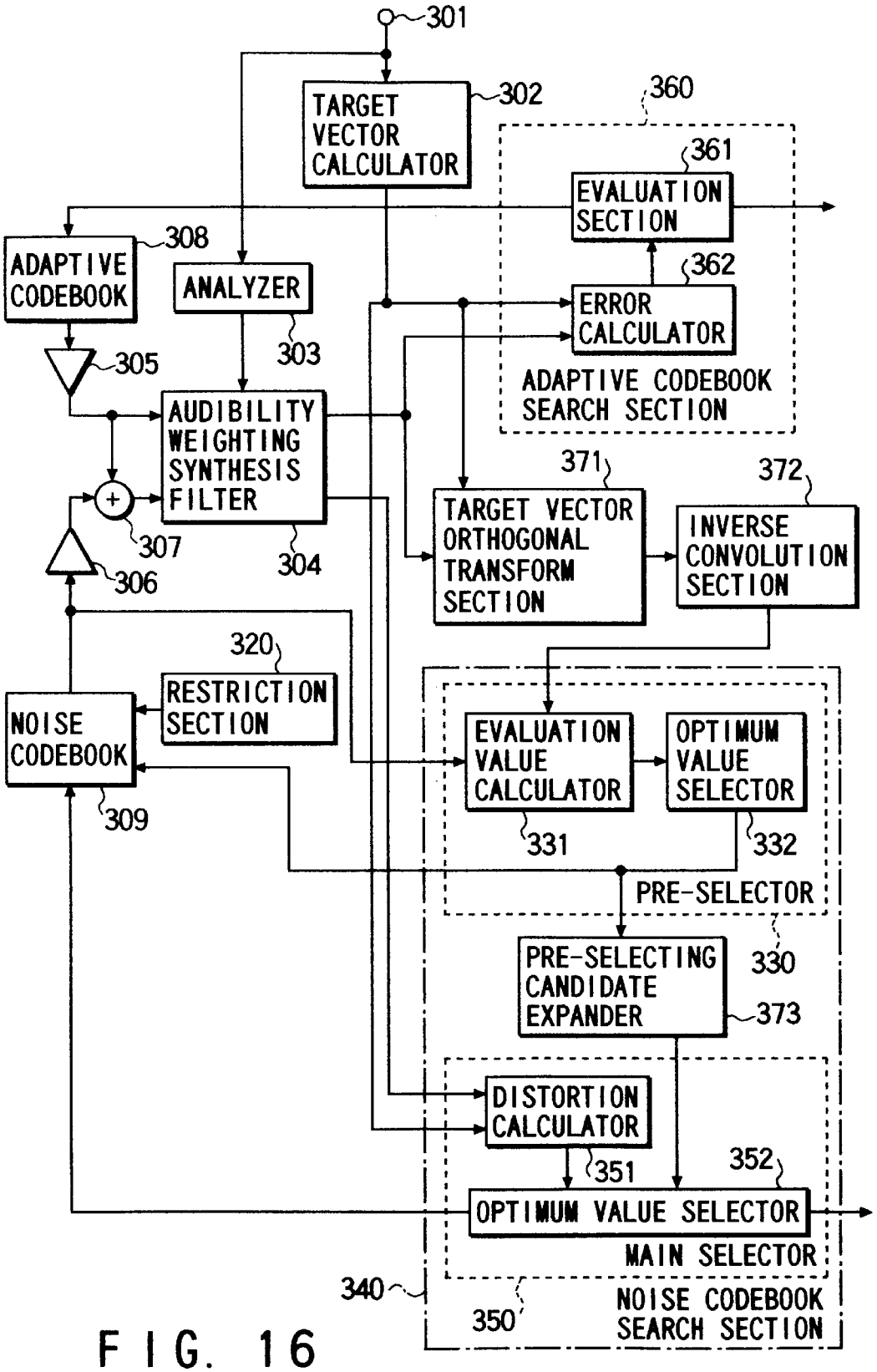
FIG. 16 is a block diagram showing the arrangement of a speech encoding apparatus according to still another embodiment.

An embodiment in which the vector quantization method explained with reference to FIG. 13 is applied to a CELP speech encoding method will be described below. FIG. 16 shows the arrangement of a speech encoding apparatus using this speech encoding method.

In FIG. 16, an input speech signal divided into frames is input from an input terminal 301. An analyzer 303 performs linear prediction analysis for the input speech signal to determine the filter coefficient of an audibility weighting synthesis filter 304. The input speech signal is also input to a target vector calculator 302 where the signal is generally passed through an audibility weighting filter. Thereafter, a target vector is calculated by subtracting zero-input response of the audibility weighting synthesis filter 304.

In this embodiment, the apparatus has an adaptive codebook 308 and a noise codebook 309 as codebooks. Although not shown, the apparatus is commonly also equipped with a gain codebook. An adaptive code vector and a noise code vector selected from the adaptive codebook 308 and the noise codebook 309 are multiplied by gains by gain suppliers 305 and 306, respectively, and added by an adder 307. The sum is supplied as a drive signal to the audibility weighting synthesis filter 304 and convoluted, generating a synthesis speech vector. A distortion calculator 351 calculates distortion of this synthesis speech vector with respect to a target vector. An optimum adaptive code vector and an optimum noise code vector by which this distortion is minimized are selected from the adaptive codebook 308 and the noise codebook 309, respectively. The foregoing is the basis of codebook search in the CELP speech encoding.

If the above distortion calculation is performed for all combinations of the code vectors stored in the adaptive codebook 308 and the noise codebook 309 in order to select the optimum combination of the adaptive code vector and the noise code vector, the processing becomes difficult to perform with a practical calculation amount. Therefore, sequential search is used in which the adaptive codebook 308 is first searched and then the noise codebook 309 is searched. That is, in an adaptive codebook searching section 360, a distortion calculator 362 calculates distortion of the adaptive code vector, which is convoluted by the audibility weighting synthesis filter 304, with respect to the target vector. An evaluation section 361 selects an adaptive code vector by which the distortion is minimized.

Subsequently, a noise code vector which minimizes the error from the target vector when combined with the adaptive code vector thus selected is selected from the noise codebook 309. In this selection, two-stage search is performed to further reduce the calculation amount. That is, a target vector orthogonal transform section 371 orthogonally transforms the target value with respect to the optimum adaptive code vector selected by searching the adaptive codebook 308 and convoluted by the audibility weighting synthesis filter 304. The resulting target vector is further inversely convoluted by an inverse convolution calculator 372, forming an inversely convoluted, orthogonally transformed target vector for pre-selection. The target vector orthogonal transform section 371 is unnecessary if no orthogonal transform search is performed. If this is the case, an adaptive code vector multiplied by a quantized gain by the gain supplier 305 is subtracted from the target vector. The resulting target vector is used instead of the output from the target vector orthogonal transform section 371.

Subsequently, an evaluation value calculator 331 of a pre-selector 330 calculates evaluation values for code vectors restricted by a restriction section 320 from the noise code vectors stored in the noise codebook 309. An optimum value selector 332 selects a plurality of noise code vectors by which these evaluation values are optimized as pre-selecting candidates.

A pre-selecting candidate expander 373 forms expanded pre-selecting candidates by adding noise code vectors which are positioned around the pre-selecting candidates and are not restricted by the restriction section 320, and outputs the expanded pre-selecting candidates to a main selector 350. In the main selector 350, the distortion calculator 351 calculates distortion of the noise code vector convoluted by the audibility weighting synthesis filter 304 with respect to the noise code vectors as the expanded pre-selecting candidates. An optimum value selector 352 selects an optimum noise code vector which minimizes this distortion.

A large difference between the pre-selector 330 and the main selector 350 is that while the pre-selector 330 searches the noise codebook 309 without using the audibility weighting synthesis filter 304, the main selector 350 performs the search by passing noise code vectors through the audibility weighting synthesis filter 304. The operation of convoluting the noise code vectors in the audibility weighting synthesis filter 304 has a large calculation amount. Therefore, the calculation amount required for the search can be reduced by performing this two-stage search. However, if all the noise code vectors stored in the noise codebook 309 are searched in the stage of pre-selection, the pre-selection calculation amount increases since the size of the noise codebook 309 is large. This increases the pre-selection calculation amount in the search of the whole noise codebook 309.

This embodiment, however, includes the restriction section 320. In the pre-selection stage, search is performed by practically regarding the noise codebook 309 as a small codebook to obtain noise code vectors as pre-selecting candidates. Thereafter, other noise code vectors which can be selected when pre-selection is performed for the whole noise codebook 309 are predicted and added as new pre-selecting candidates, thereby generating expanded pre-selecting candidates. Main selection is performed for the noise code vectors as the expanded pre-selecting candidates. In this manner, the calculation amount required for the pre-selection can be reduced without decreasing the size of the noise codebook 309. Consequently, it is possible to efficiently reduce the calculation amount necessary for the search of the whole noise codebook 309.

The arrangement of a vector quantizer to which a vector quantization method according to still another embodiment is applied will be described below with reference to FIG. 17. This vector quantizer comprises a first input terminal 400, a second input terminal 401, an overlapped codebook 410, a first inverse convolution section 420, a second inversion convolution section 430, a convolution section 440, a pre-selector 450, and a main selector 460. A filter coefficient is input to the first input terminal 400. A target vector is input to the second input terminal 401. The first inverse convolution section 420 inversely convolutes the target vector. The second inverse convolution section 430 inversely convolutes code vectors extracted from the overlapped codebook 410. The convolution section 440 convolutes and weights code vectors extracted from the overlapped codebook 410. From the code vectors extracted from the overlapped codebook 410, the pre-selector 450 selects a plurality of code vectors relatively close to the target vector as pre-selecting candidates. The main selector 460 selects an optimum code vector closer to the target vector from the code vectors as the pre-selecting candidates.

The pre-selector 450 comprises an evaluation value calculator 451 and an optimum value selector 452. The evaluation value calculator 451 calculates evaluation values related to distortions of the code vectors as selection objects for the pre-selecting candidates. On the basis of these evaluation values, the optimum value selector 452 selects a plurality of code vectors as the pre-selecting candidates.

The main selector 460 comprises a distortion calculator 461 and an optimum value selector 462. The distortion calculator 461 calculates distortions of the code vectors extracted from the overlapped codebook 410 with respect to the target vector. On the basis of the calculated distortions, the optimum value selector 462 selects an optimum code vector from the code vectors as the pre-selecting candidates.

The operation of this embodiment will be described in detail below.

A filter coefficient is input from the first input terminal 400, and a target vector is input from the second input terminal 401. The first inverse convolution section 420 inversely convolutes the target vector, and the inversely convoluted vector is input as a filter coefficient to the second inverse convolution section 430. The second inverse convolution section 430 inversely convolutes code vectors extracted from the overlapped codebook 410. The result of the inverse convolution is input to the evaluation value calculator 451 in the pre-selector 450, and the optimum value selector 452 selects pre-selecting candidates. In the main selector 460, the distortion calculator 461 calculates distortions of these code vectors as the pre-selecting candidates with respect to the target vector. On the basis of the calculated distortions, the optimum value selector 462 selects an optimum code vector. The index of this optimum code vector is output as a vector quantization result.

The conventional search method of performing no two-stage search is equivalent to the method in which search is performed only in the main selector 460. The operation of this method is as follows. The distortion calculator 461 in the main selector 460 receives an input target vector from the second input terminal 401 and code vectors weighted by the convolution section 440 and calculates distortions of the code vectors with respect to the target vector. Although several methods are usable as this distortion calculation method, an evaluating expression indicated by equation (14) below which minimizes the distance between a code vector and a target vector is often used as one simple method.

$$Ei = \frac{(R, H\,Ci)^2}{|HCi|^2} \tag{14}$$

where Ei is an evaluation value, R is a target vector, Ci is a code vector, H is a matrix representing filtering in the second convolution section 440, i.e., a filter coefficient input to the input terminal 400.

Subsequently, the optimum value selector 462 selects the code vector Ci by which the evaluation value Ei is maximized. The calculation amount of the code vector convolution operation, i.e., the amount of calculations of HCi is large, and the calculations must be performed for all the code vectors Ci. This makes high-speed codebook search difficult. One method by which this problem is solved is the two-stage search method described earlier.

An example of the evaluating expression used in the pre-selector 450 is a method using the numerator of equation (14). By deforming the numerator as indicated by equation (15) below, the value of the numerator can be calculated by calculating an inner product once and squaring the result without convoluting the code vectors Ci.

$$(R, Hci)^2 = (RtH, Ci)^2 \tag{15}$$

where Rt means transposition of R.

In equation (15), the calculation of RtH is called inverse convolution (backward filtering) which can also be realized by inputting R in a temporally opposite direction into a filter represented by the matrix H and again inverting the output. On the other hand, the convolution operation in the main selector 460 needs to be performed only for the code vectors as the pre-selecting candidates selected by the pre-selector 450. This allows high-speed codebook search.

In this embodiment, the calculation amount in the pre-selection can be effectively reduced as follows when the codebook has an overlap structure. The inner product of the code vector Ci extracted from the overlapped codebook 410 and RtH can be calculated by inversely convoluting the code vector Ci with RtH. Assume that an original code vector stored in the overlapped codebook 410 is Co and the length of the code vector Co is M. Assume also that a code vector obtained by extracting N samples from the ith sample in the original code vector Co and having a length of N is Ci. That is, The operation by which Co is inversely convoluted by RtH is represented by an expression as follows.

$$d(i) = \sum_{t=i}^{M} Co(t)RtH(t-i) \tag{16}$$

Since RtH is an inversely convoluted vector of a target vector, the length of RtH is N. When this is taken into consideration, equation (16) can be rewritten as follows:

$$d(i) = \sum_{t=i}^{i+N-1} Co(t)RtH(t-i) \tag{17}$$

and can be deformed as follows.

$$\begin{aligned} d(i) &= \sum_{t=0}^{N-1} Co(i+t)RtH(t) \\ &= \sum_{t=0}^{N-1} Ci(t)RtH(t) \end{aligned} \tag{18}$$

Equation (18) represents the inner product of Ci and RtH.

From the foregoing, to calculate the numerator of the evaluating expression, it is only necessary to cause the second inverse convolution section 430 to inversely convolute the code vector Ci extracted from the overlapped codebook 410 with the target vector RtH which is inversely convoluted by the first inverse convolution section 420, and square a result d(i) of this inverse convolution to obtain d(i)2.

In the case of the overlapped codebook, individual vectors need not be inversely convoluted. That is, the values of d(i) can be continuously calculated and the inner products can be calculated at a high speed by once convoluting the whole overlapped codebook.

More specifically, the first inverse convolution section 420 inversely convolutes an input target vector R to the second input terminal 401 with a filter coefficient H input to the first input terminal 400, and outputs RtH. The second inverse convolution section 430 inversely convolutes the overlapped codebook Co with this RtH and inputs d(i) to the evaluation value calculator 451 in the pre-selector 450. On the basis of this inversely convoluted code vector d(i), the evaluation value calculator 451 calculates and outputs an evaluation value, e.g., $d(i)^2$. As the evaluation value, it is also possible to use $|d(i)|$, $|d(i)|/|Ci|$, or $d(i)^2/Ci^2$ instead of $d(i)^2$.

The arrangement of this embodiment particularly has a large effect of reducing the calculation amount when the overlapped codebook 410 is center-clipped. Center clip is a technique by which a sample smaller than a predetermined value in each code vector is replaced with 0. A center-clipped codebook has a structure in which pulses rise discretely. In this embodiment, calculations are done by using equation (16). Accordingly, it is readily possible to perform calculations only for places where pulses exist in the overlapped codebook Co. Consequently, the calculation amount can be greatly reduced.

For the sake of simplicity, in the above explanation adjacent code vectors in code vectors extracted from the overlapped codebook 410 are shifted one sample. However, the number of samples to be shifted is not limited to one and can be two or more. Also, the first and second inverse convolution sections 420 and 430 need only perform operations equivalent to convolution operations, i.e., do not necessarily perform operations by constituting filters.

In the vector quantization method according to this embodiment, when codebook search is performed for the overlapped codebook 410, inverse convolution operations are performed instead of inner product operations in calculating evaluation values concerning distortions of code vectors extracted from the codebook 410 with respect to a target vector. Consequently, the calculation amount can be effectively reduced and this allows high-speed vector quantization.

Figure 17:
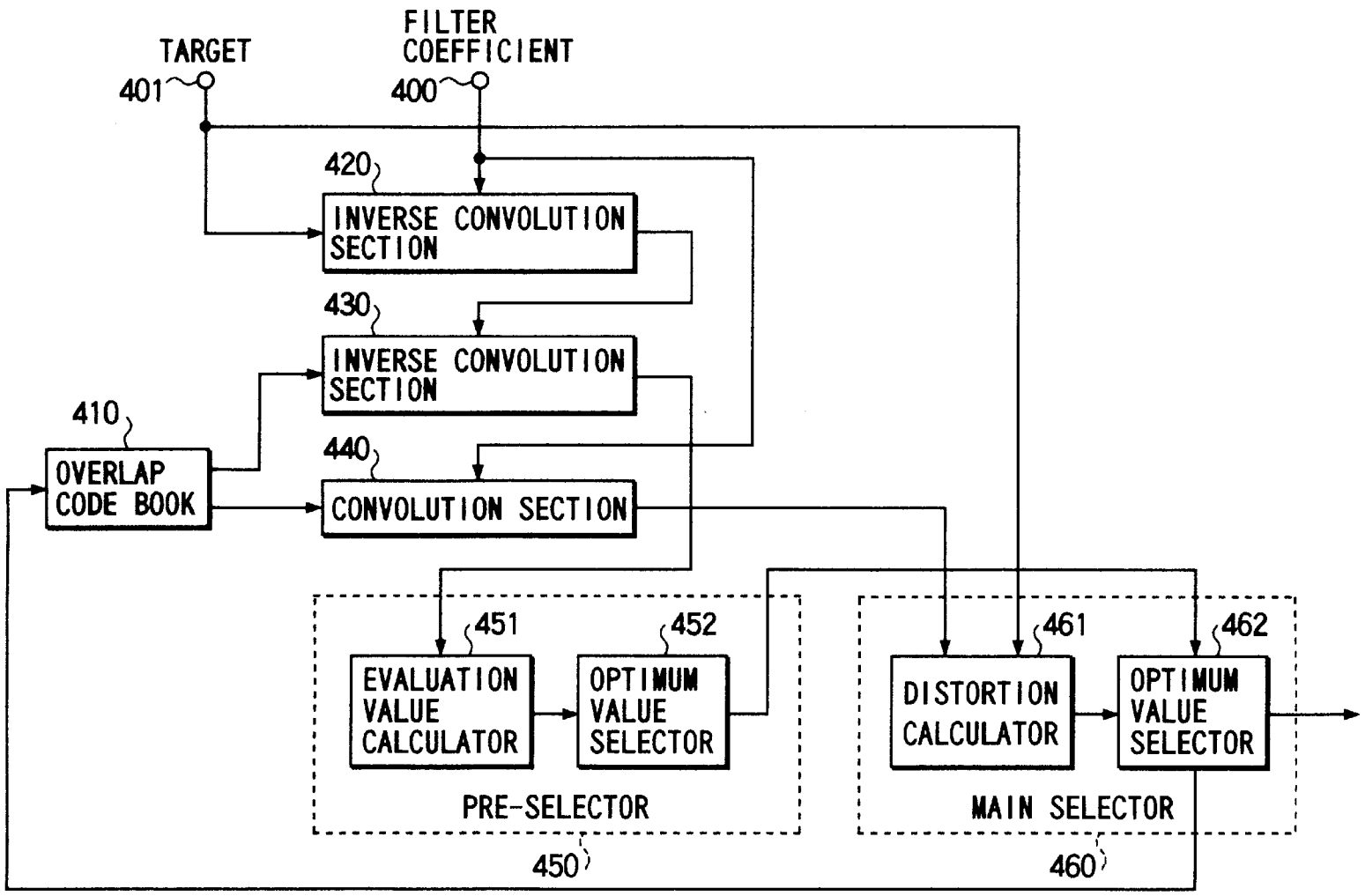
FIG. 17 is a block diagram showing the arrangement of a vector quantizer according to still another embodiment.
Figure 18:
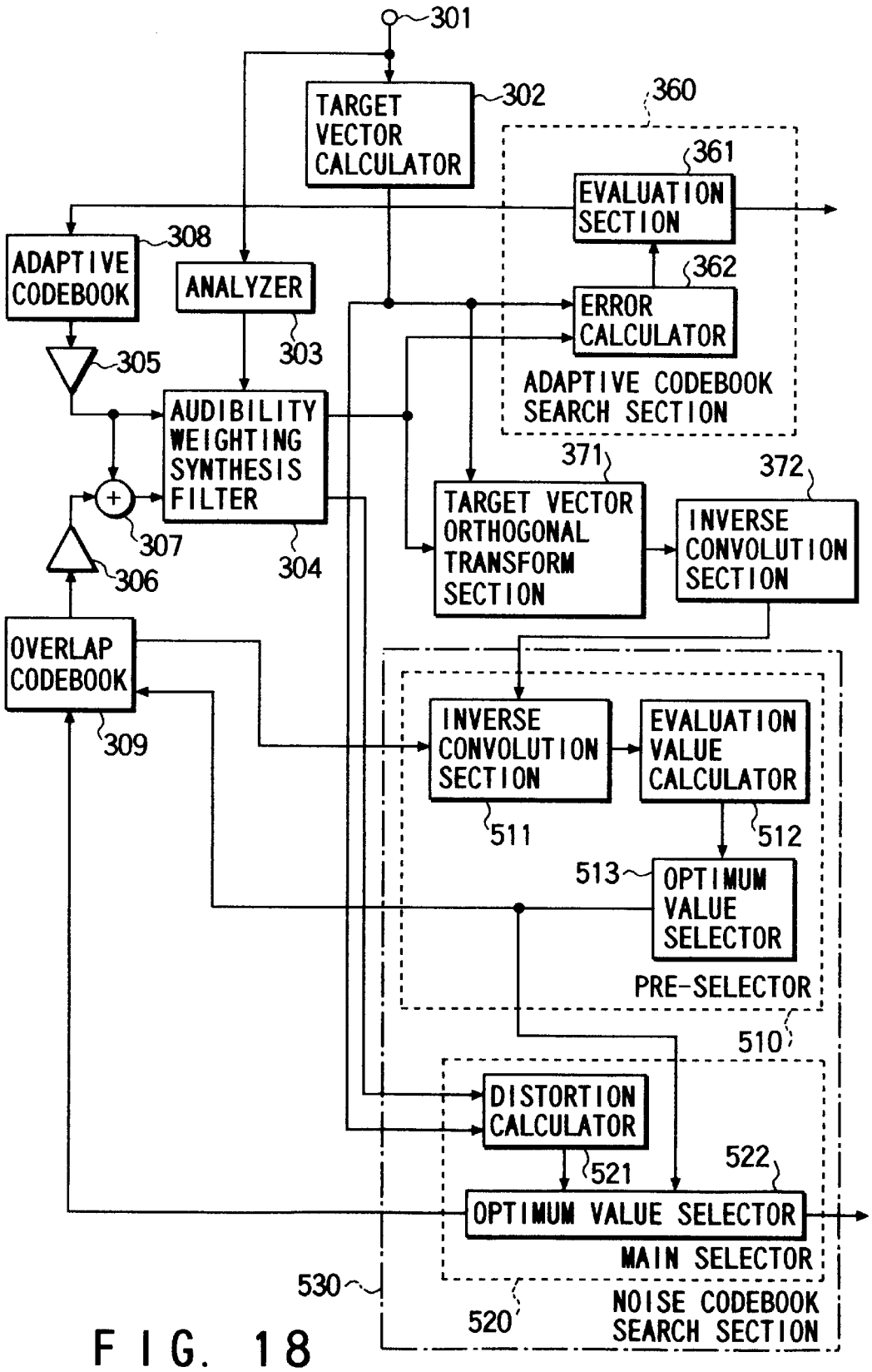
FIG. 18 is a block diagram showing the arrangement of a speech encoding apparatus according to still another embodiment.

An embodiment in which the vector quantization method explained in the embodiment shown in FIG. 17 is applied to a CELP speech encoding method will be described below. FIG. 18 shows the arrangement of a speech encoding apparatus to which this speech encoding method is applied. The speech encoding apparatus of this embodiment is identical with the speech encoding apparatus of the embodiment shown in FIG. 13 except that the apparatus includes a noise codebook search section 530 and does not include the restriction section 320 and a noise codebook 309 has an overlap structure.

Accordingly, the noise codebook search section 530 will be particularly described below.

The noise codebook search section 530 consists of a pre-selector 510 and a main selector 520. The pre-selector 510 receives an output inversely convoluted, orthogonally transformed target vector from an inverse convolution section 372 as a filter coefficient of a second inverse convolution section 511. The second inverse convolution section 511 performs an inverse convolution operation for the overlapped codebook 309 as a noise codebook. The inversely convoluted vectors are input to an evaluation value calculator 512 where evaluation values are calculated. On the basis of the calculated evaluation values, an optimum value selector 513 selects and inputs a plurality of pre-selecting candidates to the main selector 520.

In the main selector 520, a distortion calculator 521 calculates distortions of the noise code vectors as the pre-selecting candidates with respect to a target vector. On the basis of the calculated distortions, an optimum value selector 522 selects an optimum noise code vector.

In CELP speech encoding, several hundreds of code vectors are stored in a noise codebook. Accordingly, the calculation amount of pre-selection is too large to be ignored in the conventional two-stage search method. In contrast, when the noise codebook has an overlap structure and the arrangement of this embodiment is used, the calculation amount required for search of the overlapped codebook 309 as a noise codebook can be greatly reduced. If the noise codebook is center-clipped, the calculation amount necessary for the codebook search can be further reduced.

As has been described above, in the first vector quantization method of the present invention, the number of code vectors as selection objects for pre-selecting candidates is restricted in the two-stage search method. Accordingly, a calculation amount necessary for pre-selection can be reduced even if the size of a codebook is large. This makes high-speed vector quantization feasible. Additionally, by expanding the pre-selecting candidates, the vector quantization can be performed without lowering the search accuracy.

In the speech encoding method of the present invention, the first quantization method is used in search of a noise codebook. Accordingly, a calculation amount required for pre-selection of noise code vectors can be reduced. Furthermore, search of an optimum noise code vector as main selection is performed for pre-selecting candidates expanded by adding new pre-selecting candidates to restricted pre-selecting candidates. Consequently, a sufficiently high accuracy of the noise codebook search can be ensured.

In the second vector quantization method of the present invention, when an overlapped structure codebook is to be searched, an inverse convolution operation is performed instead of an inner production operation in calculating evaluation values of code vectors extracted from the codebook with respect to a target vector. This reduces the calculation amount and makes high-speed vector quantization possible.

Also, in the speech encoding method of the present invention, the second vector quantization method is used in search of a noise codebook. Consequently, a calculation amount required for the noise codebook search can be reduced and this allows high-speed speech encoding.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalent.

What is claimed as new and desired to be secured by Letters Patent of the United States is:

1. A speech encoding method using a codebook expressing speech parameters within a predetermined search range, comprising:

analyzing an input speech signal in an audibility weighting filter corresponding to a pitch period longer than the search range of the codebook; and searching, from the codebook, on the basis of the analysis result, a combination of speech parameters by which distortion is minimized, and encoding the combination.

2. A method according to claim 1, wherein the codebook uses an adaptive codebook expressing a plurality of pitch periods within a predetermined search range and a noise codebook expressing a noise string within a predetermined number of candidates, and the searching of the codebook includes searching the adaptive codebook and the noise codebook on the basis of the analysis result and combining a pitch period and a noise string by which the distortion is minimized.

3. A method according to claim 1, wherein the analyzing of an input speech signal includes using the audibility weighting filter and setting a transfer function of the audibility weighting filter on the basis of an LPC coefficient obtained by performing LPC analysis for an input speech signal and a pitch period and a pitch filter coefficient obtained by analyzing the input speech signal in units of frames, and filtering the input speech signal in accordance with the transfer function.

4. A method according to claim 3, further comprising calculating a prediction residual error signal of the input speech signal by using the LPC coefficient, calculating, on the basis of a signal obtained by multiplying the prediction residual error signal by a Hamming window, an autocorrelation value within a predetermined pitch period analysis range, calculating a pitch period at which the autocorrelation value is a maximum, and calculating the pitch filter coefficient from the prediction residual error signal and the pitch period.

5. A speech encoding method comprising:

analyzing a pitch period of an input speech signal and supplying the pitch period of the input speech signal to a pitch filter which suppresses a pitch period component;

setting an analysis range of the pitch period to be supplied to the pitch filter so that the analysis range is wider than a range of a pitch period which can be expressed by encoded data of a pitch period stored in a codebook; and searching the pitch period of the input speech signal from the codebook on the basis of a result of analysis performed for the input signal by an audibility weighting filter including the pitch filter, and encoding the pitch period.

6. A method according to claim 5, wherein assuming that the range of the pitch period (TL) which can be expressed by the encoded data is TLL≦TL≦TLH and the analysis range of the pitch period (TW) to be supplied to the pitch filter is TWL≦TW≦TWH, at least one of conditions TLL>TWL and TLH<TWH is met.

7. A speech encoding apparatus comprising:

a codebook expressing speech parameters within a predetermined search range;

an audibility weighting filter for analyzing an input speech signal on the basis of an analysis range of pitch period which is wider than the search range of the codebook; and an encoder for searching, from the codebook, on the basis of the analysis result, a combination of speech parameters by which distortion is minimized, and encoding the combination.

8. An apparatus according to claim 7, wherein the codebook has an adaptive codebook expressing a plurality of pitch periods within a predetermined search range and a noise codebook expressing a noise string within a predetermined number of candidates, and the encoder comprises means for searching the adaptive codebook and the noise codebook on the basis of the analysis result and combining a pitch period and a noise string by which the distortion is minimized.

9. An apparatus according to claim 7, wherein the audibility weighting filter comprises a filter for setting a transfer function on the basis of an LPC coefficient obtained by performing LPC analysis for an input speech signal and a pitch period and a pitch filter coefficient obtained by analyzing the input speech signal in units of frames, and filtering the input speech signal in accordance with the transfer function.

10. An apparatus according to claim 9, further comprising a calculator for calculating a prediction residual error signal of the input speech signal by using the LPC coefficient, a pitch period analyzer for calculating, on the basis of a signal obtained by multiplying the prediction residual error signal by a Hamming window, an autocorrelation value within a predetermined pitch period analysis range, and calculating a pitch period at which the autocorrelation value is a maximum, and a pitch filter coefficient analyzer for calculating the pitch filter coefficient from the prediction residual error signal and the pitch period.

11. A speech encoding apparatus comprising:

a pitch filter which suppresses a pitch period component of a speech signal;

means for analyzing a pitch period of an input speech signal and supplying the pitch period of the input speech signal to the pitch filter;

means for setting an analysis range of the pitch period to be supplied to the pitch filter so that the analysis range is wider than a range of a pitch period which can be expressed by encoded data of a pitch period stored in a codebook; and means for searching the pitch period of the input speech signal from the codebook on the basis of a result of analysis performed for the input signal by an audibility weighting filter including the pitch filter, and encoding the pitch period.

12. An apparatus according to claim 11, wherein assuming that the range of the pitch period (TL) which can be expressed by the encoded data is TLL≦TL≦TLH and the analysis range of the pitch period (TW) to be supplied to the pitch filter is TWL≦TW≦TWH, at least one of conditions TLL>TWL and TLH<TWH is met.

13. A speech decoding method comprising:

analyzing a pitch period of a decoded speech signal obtained by decoding encoded data;

passing the decoded speech signal through a post filter including a pitch filter for emphasizing a pitch period component of the decoded speech signal; and setting an analysis range of the pitch period to be supplied to the pitch filter so that the analysis range is wider than a range of a pitch period which can be expressed by the encoded data.

14. A method according to claim 13, wherein assuming that the range of the pitch period (TL) which can be expressed by the encoded data is TLL≦TL≦TLH and the analysis range of the pitch period (TP) to be supplied to the pitch filter is TPL≦TP≦TPH, at least one of conditions TLL>TPL and TLH<TPH is met.

15. A speech decoding apparatus comprising:

means for analyzing a pitch period of a decoded speech signal obtained by decoding encoded data;

a post filter including a pitch filter for emphasizing a pitch period component of the decoded speech signal; and means for setting an analysis range of the pitch period to be supplied to the pitch filter so that the analysis range is wider than a range of a pitch period which can be expressed by the encoded data.

16. An apparatus according to claim 15, wherein assuming that the range of the pitch period (TL) which can be expressed by the encoded data is TLL≦TL≦TLH and the analysis range of the pitch period (TP) to be supplied to the pitch filter is TPL≦TP≦TPH, at least one of conditions TLL>TPL and TLH<TPH is met.

17. A vector quantization method comprising:

selecting, as pre-selecting candidates, a plurality of code vectors relatively close to a target vector from a predetermined code vector group;

generating expanded pre-selecting candidates by restricting selection objects for the pre-selecting candidates to some code vectors of the code vector group, selecting some code vectors other than the selection objects from the code vector group on the basis of the pre-selecting candidates and adding the selected code vectors as new pre-selecting candidates; and searching an optimum code vector closer to the target vector from the expanded pre-selecting code vectors.

18. A vector quantization method comprising:

selecting, as pre-selecting candidates, a plurality of code vectors relatively close to a target vector from a code vector group formed by extracting code vectors of a predetermined length from one original code vector while sequentially shifting positions of the code vectors such that adjacent code vectors overlap each other;

generating expanded pre-selecting candidates by restricting selection objects for the pre-selecting candidates to some code vectors positioned at predetermined intervals in the code vector group and adding code vectors in the code vector group, other than the selection objects and positioned near the pre-selecting candidates, as new pre-selecting candidates; and searching an optimum code vector closer to the target vector from the expanded pre-selecting candidates.

19. A speech encoding method comprising:

generating a drive signal by using an adaptive code vector and a noise code vector;

supplying the drive signal to a synthesis filter whose filter coefficient is set on the basis of an analysis result of an input speech signal, thereby generating a synthesis speech vector;

searching an optimum adaptive code vector and an optimum noise code vector for generating a synthesis speech vector close to a target vector calculated from the input speech signal from a predetermined adaptive code vector group and a predetermined noise code vector group, respectively;

orthogonally transforming the target vector with respect to the optimum adaptive code vector convoluted by the synthesis filter and inversely convoluting the target vector by the synthesis filter, thereby generating an inversely convoluted, orthogonally transformed target vector;

restricting some noise code vectors in the noise code vector group as selection objects for pre-selecting candidates;

calculating evaluation values relating to distortions of the noise code vectors as the selection objects with respect to the inversely convoluted, orthogonally transformed target vector, and selecting the pre-selecting candidates from the selection object noise code vectors on the basis of the evaluation values;

selecting, on the basis of the pre-selecting candidates, some noise code vectors other than the selection objects from the noise code vector group and adding the selected noise code vectors to the pre-selecting candidates, thereby generating expanded pre-selecting candidates; and searching the optimum noise code vector from the expanded pre-selecting candidates.

20. A vector quantization method comprising:

weighting each code vector of a code vector group formed by cutting out code vectors of a predetermined length from one original code vector while sequentially shifting positions of the code vectors such that adjacent code vectors overlap each other;

inversely convoluting a target vector of the weighted code vectors and inversely convoluting the original code vector by using the inversely convoluted target vector as a filter coefficient, thereby calculating evaluation values related to distortions with respect to the target vector; and searching a code vector relatively close to the target vector from the code vector group on the basis of the evaluation values.

21. A vector quantization method comprising:

weighting each code vector of a code vector group formed by extracting code vectors of a predetermined length from one original code vector while sequentially shifting positions of the code vectors such that adjacent code vectors overlap each other;

inversely convoluting a target vector of the weighted code vectors and inversely convoluting the original code vector by using the inversely convoluted target vector as a filter coefficient, thereby calculating evaluation values related to distortions with respect to the target vector; and selecting, as pre-selecting candidates, a plurality of code vectors relatively close to the target vector from the code vector group on the basis of the evaluation values, and searching an optimum code vector closer to the target vector from the pre-selecting candidates.

22. A speech encoding method comprising:

generating a drive signal by using an adaptive code vector and a noise code vector;

supplying the drive signal to a synthesis filter whose filter coefficient is set on the basis of an analysis result of an input speech signal, thereby generating a synthesis speech vector;

searching an optimum adaptive code vector and an optimum noise code vector for generating a synthesis speech vector close to a target vector calculated from the input speech signal from a predetermined adaptive code vector group and a noise code vector group formed by cutting out code vectors of a predetermined length from one original code vector while sequentially shifting positions of the code vectors such that adjacent noise code vectors overlap each other, respectively;

orthogonally transforming the target vector with respect to the optimum adaptive code vector convoluted by the synthesis filter and inversely convoluting the target vector by the synthesis filter, thereby generating an inversely convoluted, orthogonally transformed target vector;

inversely convoluting the original code vector with the inversely convoluted, orthogonally transformed target vector, calculating evaluation values related to distortions of the noise code vectors with respect to the inversely convoluted, orthogonally transformed target vector from the inversely convoluted original code vector, and selecting pre-selecting candidates from the noise code vector group on the basis of the evaluation values; and searching the optimum noise code vector from the pre-selecting candidates.

* * * * *